US008647167B2

(12) United States Patent
Heilbron et al.

(10) Patent No.: US 8,647,167 B2
(45) Date of Patent: Feb. 11, 2014

(54) LIGHTED DISPLAY DEVICES FOR PRODUCING STATIC OR ANIMATED VISUAL DISPLAYS, INCLUDING ANIMATED FACIAL FEATURES

(76) Inventors: Valerie J. Heilbron, Albuquerque, NM (US); Paul G. Clem, Albuquerque, NM (US); Adam Wade Cook, Albuquerque, NM (US)

( * ) Notice: Subject to any disclaimer, the term of this patent is extended or adjusted under 35 U.S.C. 154(b) by 669 days.

(21) Appl. No.: 12/907,692

(22) Filed: Oct. 19, 2010

(65) Prior Publication Data

US 2011/0092131 A1 Apr. 21, 2011

Related U.S. Application Data

(63) Continuation-in-part of application No. 12/860,857, filed on Aug. 20, 2010, now abandoned.

(60) Provisional application No. 61/274,716, filed on Aug. 20, 2009.

(51) Int. Cl.
*A63H 30/00* (2006.01)

(52) U.S. Cl.
USPC ..... 446/175; 446/337; 349/56; 349/62

(58) Field of Classification Search
USPC ..... 446/26–27, 175, 391, 395; 349/56, 349/61–62
See application file for complete search history.

(56) References Cited

U.S. PATENT DOCUMENTS 3,440,349 A * 4/1969 Gibbs ..... 340/540
3,841,020 A 10/1974 Ryan et al.
4,185,276 A 1/1980 Benson
4,729,564 A * 3/1988 Kuna et al. ..... 463/9
4,808,142 A 2/1989 Berliner
4,828,531 A * 5/1989 Kuhn ..... 446/392
4,875,144 A 10/1989 Wainwright
5,000,714 A * 3/1991 Su ..... 446/392
5,128,843 A 7/1992 Guritz
5,432,876 A 7/1995 Appeldorn et al.
5,461,188 A 10/1995 Drago
5,631,994 A 5/1997 Appeldorn et al.
6,134,092 A * 10/2000 Pelka et al. ..... 361/31
6,238,263 B1 * 5/2001 Bennett ..... 446/330

(Continued)

FOREIGN PATENT DOCUMENTS

GB 2200567 A * 8/1988 ..... A63H 3/00

OTHER PUBLICATIONS

GB 2200567 A Aug. 10, 1988, A Toy Character, Stubenfoll et al., 14 Pages.*

*Primary Examiner* — Dmitry Suhol
*Assistant Examiner* — Alex F. R. P. Rada, II
(74) *Attorney, Agent, or Firm* — O'Connell Law Firm; Thomas P. O'Connell

(57) ABSTRACT

An illuminated display device with a base member with a plurality of cavities therein. Illumination devices illuminate the cavities and emit light through an opening of the cavities in a pattern, and a speaker can emit sounds in synchronization with the pattern. A panel with translucent portions can overly the base member and the cavities. An animated talking character can have an animated mouth cavity complex with multiple predetermined mouth lighting configurations simulative of human utterances. The cavities can be open, or optical waveguide material or positive members can be disposed therein. Reflective material can enhance internal reflectance and light emission.

29 Claims, 20 Drawing Sheets

(56) References Cited

U.S. PATENT DOCUMENTS

| | | | | |
|---|---|---|---|---|
| 6,259,855 | B1 | 7/2001 | Lundin | |
| 6,352,464 | B1 | 3/2002 | Madland et al. | |
| 6,802,757 | B1 * | 10/2004 | Sejnowski | 446/227 |
| 6,863,428 | B2 | 3/2005 | Lundin | |
| 2008/0032593 | A1 * | 2/2008 | Chou et al. | 446/343 |

* cited by examiner

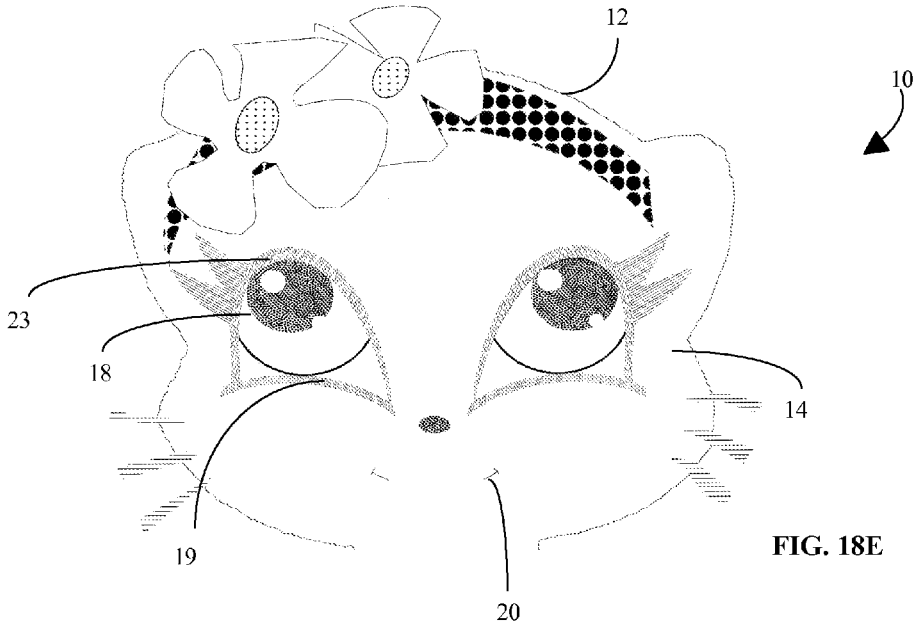
FIG. 18E
FIG. 19
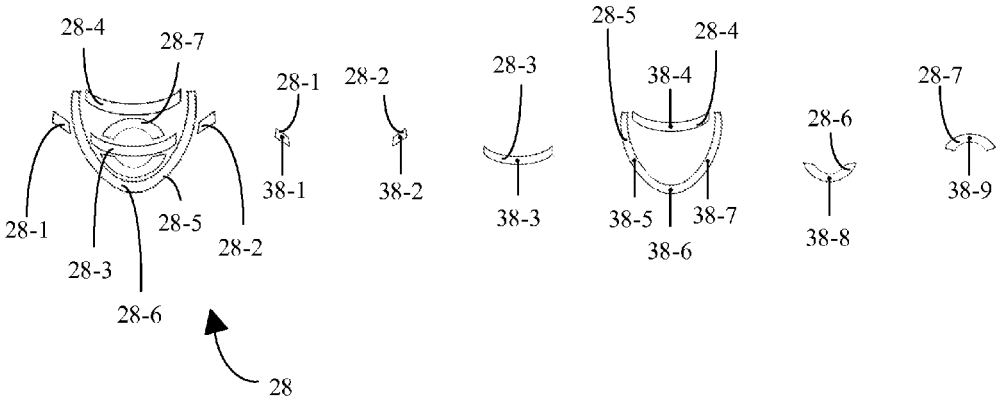

LIGHTED DISPLAY DEVICES FOR PRODUCING STATIC OR ANIMATED VISUAL DISPLAYS, INCLUDING ANIMATED FACIAL FEATURES

GOVERNMENT LICENSE RIGHTS STATEMENT

This invention was made with government supported under DE-AC04-94AL85000 awarded by the Sandia Corporation and the U.S. Department of Energy. The U.S. Government has a paid-up license in this invention and the right in limited circumstances to require the patent owner to license others on reasonable terms.

FIELD OF THE INVENTION

The present invention relates generally to illumination and visual display devices. More particularly, disclosed and protected herein are lighted display devices capable of producing static or animated visual displays, including in particular embodiments animated facial features.

BACKGROUND OF THE INVENTION

Lighted display devices are, of course, well known. By way of example, statically lighted display devices are commonly used for advertising and other types of signage. Animated lighted display devices also are in common usage, such as in relation to variable advertising mechanisms and the like.

Many devices of the prior art, however, are limited in their application. For example, the glass bulbs required for illumination are relatively delicate and cannot be employed in many types of applications that are likely to be subjected to impacts and vigorous movements. Also, it is recognized to be problematic to employ traditional illumination sources in contoured applications, such as relative to dolls and other toys. Still further, providing bright and uniform lighting—lighting devoid of noticeable hotspots—is at best challenging using traditional bulb illumination sources.

Alternative forms of illumination have been attempted in general illumination applications. For example, it is known that optically transmissive materials, such as glass or polymers, may be used as a light or wave guide to propagate light. A waveguide typically includes at least one surface adapted to receive light from a light source and an optically smooth surface for reflecting light propagating through the guide. Common examples of waveguides include optical fibers traditionally used in the data communication industry and more recently light fibers used for illumination purposes.

The prior art also discloses the extraction of light from an optical waveguide along a length of the guide. For example, U.S. Pat. No. 5,432,876 to Appeldorn et al., which is incorporated herein by reference, discloses an illumination device wherein light injected into an end of a light fiber exits the fiber at a predetermined position or positions along the length of the fiber. Light extraction structures or notches are formed in the core of the light fiber. The extraction structures define first and second reflecting surfaces, which reflect in a radial direction a portion of the light propagating axially through the fiber. The reflected light is directed at an angle that is less than the critical angle necessary for continued propagation along the fiber according to the principle of total internal reflection. As a result, the reflected light is extracted from the fiber in a controlled fashion.

However, it has been noted, for example, in U.S. Pat. No. 6,863,428 to Lundin, which is incorporated herein by reference, that the light extraction in such arrangements tended to be inconsistent in intensity. Accordingly, Lundin sought to provide a light fiber that appears uniform in brightness along its length. Under the disclosed invention, a light guide has a light guide core with an optically smooth surface for propagating light therethrough. A light emitting region, which extends along a portion of the core, includes at least one light extraction structure located along the optically smooth surface of the light guide core. The light extraction structure includes an optically reflective surface extending into the light guide core and is oriented to reflect light at an angle less than a critical angle necessary for light to propagate through the light guide core. A diffuse reflective sheet material is disposed around at least a portion of the light guide to direct at least a portion of the light reflected by the light extraction structure back through the light guide to emit the light through the light emitting region of the optically smooth surface. As taught by Lundin, the illumination structure can have a plurality of spaced light extraction structures, which may be equally or unequally spaced.

Unfortunately, even assuming Lundin to have succeeded in providing lighting of a consistent intensity along the length of a light fiber, the knowledgeable observer will appreciate that structures embodying such developments have been limited in their application. The limited application of such technologies has apparently derived from, among other things, the complexities and expense required for their manufacture and application.

It has also been the long sought after goal of many inventors to provide a toy doll capable of simulating animation, such as speech and eye movement. By way of example, U.S. Pat. No. 4,808,142 to Berliner teaches a motor driven mouth actuator that moves a doll's mouth between open and closed positions. In U.S. Pat. No. 3,841,020, Ryan employs a complex set of levers and actuators to create what is nonetheless a limited range of facial expressions. Further still, with U.S. Pat. No. 6,352,464, Madland et al. describe a facial control system where two lip chains are embedded behind two lips.

Most such dolls, however, have proven to lack realism. These prior art dolls have been unable in many cases to achieve a full range of human-like and recognizable facial expressions. Furthermore, many of these prior art dolls have required complex mechanical drive arrangements so that they have been prone to failure. Additionally, the relatively complicated dolls of the prior art have been relatively expensive in manufacture and sale. As a result, many animated dolls of the prior art have been poorly received by the consuming public and have been unable to achieve the widespread application necessary for substantial market success.

SUMMARY OF THE INVENTION

Knowing the limitations and deficiencies of the prior art, the present inventors set about with the basic object of creating lighted display devices capable of producing static or animated visual displays.

In certain embodiments, a more particular object is to provide a lighted display device capable of displaying animated facial features, such as mouth and eye movements in an application for a character toy, particularly a plush or doll toy.

An underlying object of the invention is to provide illuminated display devices demonstrating bright and uniform lighting to create clear and convincing designs, both static and animated.

Another underlying object of the invention is to provide display devices capable of demonstrating illumination in a wide variety of patterns and shapes.

Still another object of embodiments of the invention is to provide lighted display devices exhibiting bright and consistent illumination while requiring a minimum of light sources.

A further object of embodiments of the invention is to provide lighted display devices that prevent illumination from one illumination shape from unintentionally affecting other illumination shapes.

An overriding object of the invention is to provide lighted display devices that are low in manufacturing cost and high in functionality thereby to enable widespread market adoption and success in relation to toys and other display items and consumer goods.

These and in all likelihood further objects and advantages of the present invention will become obvious not only to one who reviews the present specification and drawings but also to those who have an opportunity to make use of an embodiment of the lighted display devices disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the aforementioned objects, an illuminated display device pursuant to the invention can be founded on a base member with a surface. Cavities are disposed in the base member, and each cavity has a wall surface and a cavity opening contiguous with the surface of the base member. A plurality of illumination devices are provided wherein at least one illumination device is disposed in optical communication with each cavity for providing illumination within the cavity and for emitting light through the opening. Furthermore, means, such as a processor in combination with a power source, are provided for illuminating the illumination devices in a pattern thereby to illuminate the cavities and to emit light through the opening selectively to provide an illuminated display. The illumination devices can be in direct contact with the cavities, or an optical fiber can have a first portion in optical communication with the illumination device and a second portion in optical communication with a given cavity for providing illumination in the cavity.

A panel can be applied over at least a portion of the base member and over the plurality of cavities. The panel is preferably translucent over at least a portion of each of the plurality of cavities, such as by the incorporation of lens portions. Additionally, a speaker can be incorporated for emitting sounds, such as utterances where the animated display device simulates a living being. A means, such as the processor, can be provided for synchronizing sounds emitted by the speaker with the pattern of illumination of the illumination devices.

Under certain practices of the invention, the illuminated display device can take the form of an animated talking character with a plurality of cavities that form an animated mouth cavity complex with multiple predetermined mouth lighting configurations established by selective illumination of the illumination devices in optical communication with the cavities forming the animated mouth cavity complex. For example, the animated mouth cavity complex can have a plurality of upper lip shape cavities and a plurality of lower lip shape cavities. In certain embodiments, the animated mouth cavity complex can have a lip shape cavity that simulates a contoured upper lip, a lip shape cavity that simulates a curved lower lip, and lip shape cavities that simulate pursed upper and lower lips. The multiple predetermined mouth configurations established by selective illumination of the illumination devices can include a first mouth configuration simulative of the human utterance of the letters A and I, a second mouth configuration simulative of the human utterance of the letter E, a third mouth configuration simulative of the human utterance of the letters O and U, and a fourth mouth configuration simulative of a human smile.

Still further, the animated talking character can have a left eye cavity with an illumination device in optical communication therewith and an independently operable right eye cavity with an illumination device in optical communication therewith so that the animated talking character further has left and right eyes that can be selectively illuminated. The eyes can have independently operable primary and secondary eye illuminations for each of the left and right eyes. The panel applied over the base member can have an outside surface and an inside surface and can be translucent over at least a portion of each of the plurality of cavities. Still further, first image, such as the image of an open eye can be applied to the outside surface of the panel in registration with each eye cavity, and a second image, such as another image of an eye, can be applied to the inside surface of the panel in registration with each eye cavity.

Each cavity can have an illumination volume, and a reflective material can be interposed between the illumination volume of each cavity and the base member. Each cavity can, for example, have an open inner volume bounded by a layer of reflective material applied to the wall surface of the cavity. Alternatively, optical waveguide material can be disposed in each cavity, and a layer of reflective material can be interposed between the optical waveguide material and the wall surface of the cavity. Still further, a positive, solid shaped, light emitting member of translucent material can be disposed in each cavity and in optical communication with at least one illumination device. Where such a member is provided, a layer of reflective material can be disposed on each light emitting member.

Embodiments of the invention can have optical waveguide material, such as transparent polymeric material, disposed in the cavities with the optical waveguide material in optical communication with an illumination device. The illumination devices can comprise light emitting diodes (LEDs), and at least a portion of an LED can protrude into each cavity. Under such practices of the invention, optical waveguide material can be inserted into the cavities in fluid form for subsequent curing while at least a portion of an LED protrudes into each cavity. With that, at least a portion of each LED will be encapsulated within and in direct contact with the optical waveguide material.

Illuminated display devices according to the invention can have a plurality of translucent light emitting members coupled to a base structure. A plurality of illumination devices are disposed in optical communication with each light emitting member for providing illumination within the light emitting member and for emitting light from the light emitting member. Finally, means are provided for illuminating the at least one illumination device in optical communication with each light emitting member to illuminate the light emitting members and to emit light from the light emitting members to provide an illuminated display. The base structure can be a soft material, such as batting material, and a panel can be applied over at least a portion of the base structure and over the plurality of light emitting members. The panel will preferably be translucent over at least a portion of each of the plurality of light emitting members. In such a construction, each light emitting member can have an exterior surface with a light emitting portion and a light reflecting portion comprising reflective material applied thereto.

One will appreciate that the foregoing discussion broadly outlines the more important features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

In the accompanying drawings:

FIGS. 18A through 18E are views in front elevation of an alternative lighted doll display device in various stages of animation and dormancy;

FIG. 19 provides schematic views of the mouth cavity complex of the lighted doll display;

DETAILED DESCRIPTION OF PREFERRED EMBODIMENTS

As is the case with many inventions, the present invention for a lighted display device is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
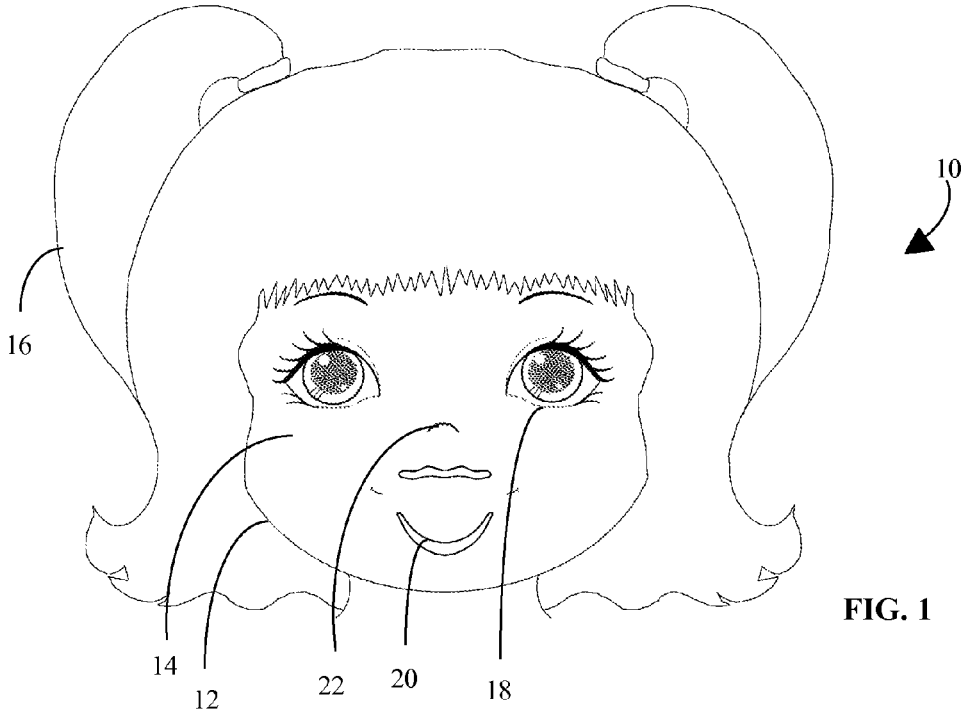
FIG. 1 is a view in front elevation of a lighted display device according to the present invention in the form of a doll in an animated condition.
Figure 2:
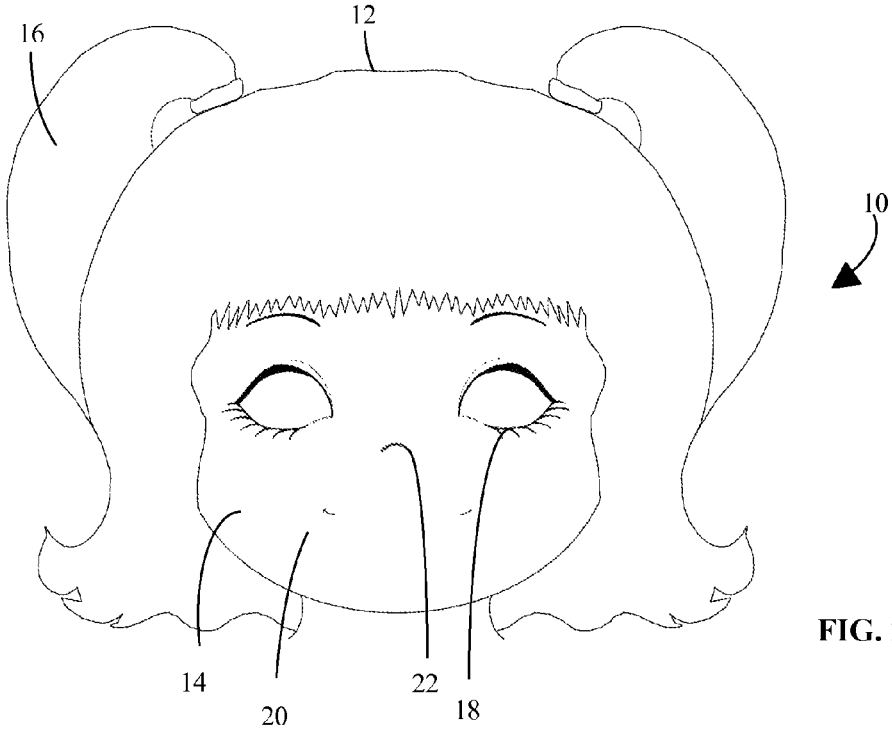
FIG. 2 is a view in front elevation of the lighted doll display device of FIG. 1 in a dormant condition.
Figure 3:
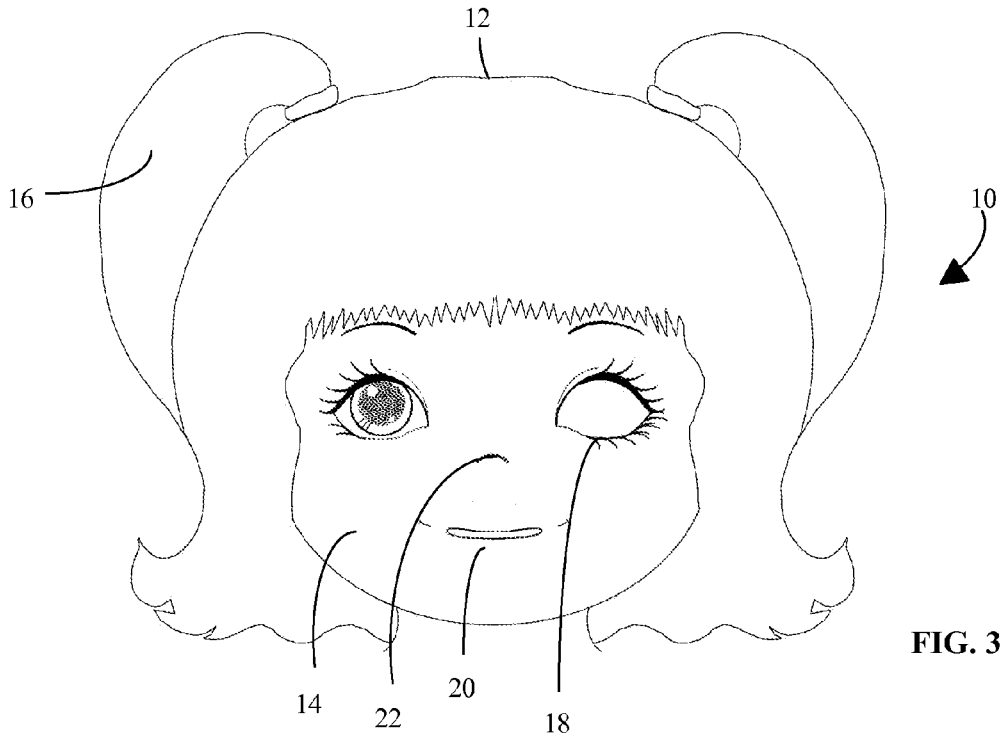
FIG. 3 is a view in front elevation of the lighted doll display device of FIG. 1 in an alternative animated condition.

An embodiment of the present invention for a lighted display device is indicated generally at 10 in FIGS. 1 through 3. There, the lighted display device 10 takes the form of a doll. However, as demonstrated below in relation to later drawing figures, it will be clear that the present invention has broader applicability to other display devices, including signage, art, toys, and potentially any other device wherein lighted display may be desirable.

The lighted doll display device 10 has a head 12 with a face 14 and hair 16. Moreover, the lighted doll display device 10 has eyes 18 and a mouth 20 capable of animation as shown and described herein. A nose 22 completes the lighted doll display device 10 to produce a realistic, or as realistic as desired, toy doll.

In FIG. 1, the display device 10 is in an animated condition under which both eyes 18 are illuminated as is the mouth 20 in a first predetermined configuration, which in this case is what could be perceived as an open smile. Alternatively, the shape of the mouth 20 could be perceived as an appearance corresponding to the utterance of certain sounds. This is particularly true when the animation is carried out in conjunction with audible output as taught herein.

In FIG. 2, the display device 10 is shown in what may be considered a dormant condition where neither the eyes 18 nor the mouth 20 are illuminated. With a lack of illumination of the eyes 18 in this embodiment, graphic designs simulative of closed eyes 18 are visible thereby giving the appearance that the lighted doll display device 10 is either blinking or at rest.

In a suggestion of the innumerable display possibilities of the invention, the lighted doll display device 10 in FIG. 3 has one eye 18 illuminated, thereby giving an open appearance, and one eye 18 not illuminated, thereby giving a closed or winking appearance. Furthermore, the mouth 20 is illuminated to achieve a second predetermined configuration, which in this case could be perceived as a closed mouth smile or an appearance corresponding to the utterance of certain sounds different than the sounds that would be expected in the first predetermined configuration of the mouth 20. By use of these and further predetermined illuminated configurations of the mouth 20, the lighted doll display device 10 can readily be employed as an animated talking character. The animation and talking can be rendered particularly convincing when sounds specifically coordinated with the configurations of the mouth 20 are emitted, whether from the lighted doll display device 10 or elsewhere, as taught under the invention.

Figure 12:
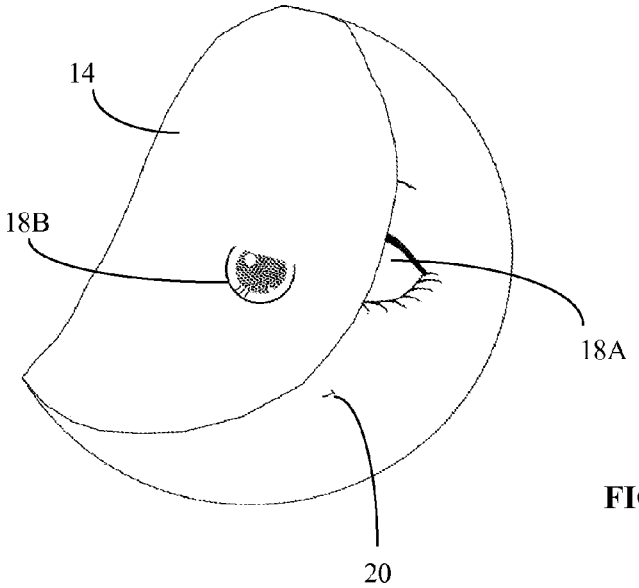
FIG. 12 is a partially overturned view in front elevation of a face panel pursuant to the instant invention.
Figure 13:
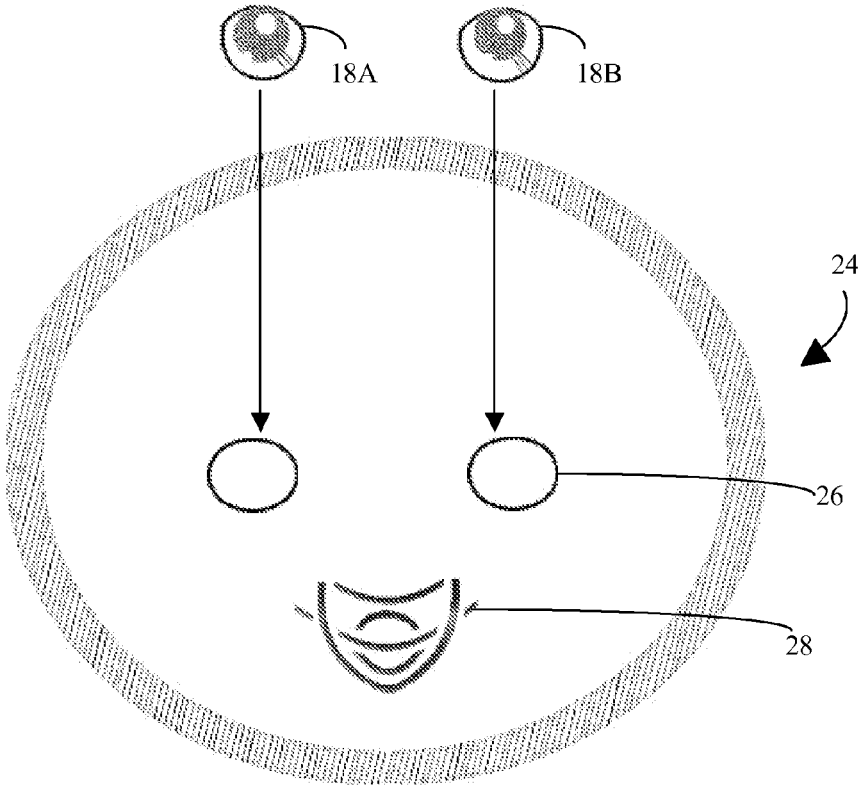
FIG. 13 is a partially exploded perspective view of a contoured base member in relation to left and right eye graphics for being applied thereto.

The animation produced by the selective depiction of closed eyes 18 as in FIG. 2 or open eyes 18 as in FIG. 1 can be achieved under the present invention by using a face panel 14 as depicted in FIG. 12. There, the face panel 14 is partially overturned so that one sees the apparently closed left eye 18A on the outside surface of the face panel 14 and the image of an open right eye 18B that is printed in exact registration on the reverse of the closed right eye (not shown). The face panel 14 can be crafted from any suitable material or materials, including printed fabric or thin polymeric material, such as vinyl. The material of the face panel 14, at least in the vicinity of the eyes 18A and 18B, is translucent. Therefore, when light illuminates the eyes 18A and 18B from behind, the eyes 18A and 18B are viewed as open, and when the light is off, the eyes 18A and 18B are viewed as closed or blinked. Exploiting this technique, the lighted doll display device 10 achieves a most realistic view of blinking eyes 18A and 18B. In the alternative embodiment of FIG. 13, the eyes 18A and 18B can be applied as separately printed members or decals atop the eye cavities 26.

Figure 4:
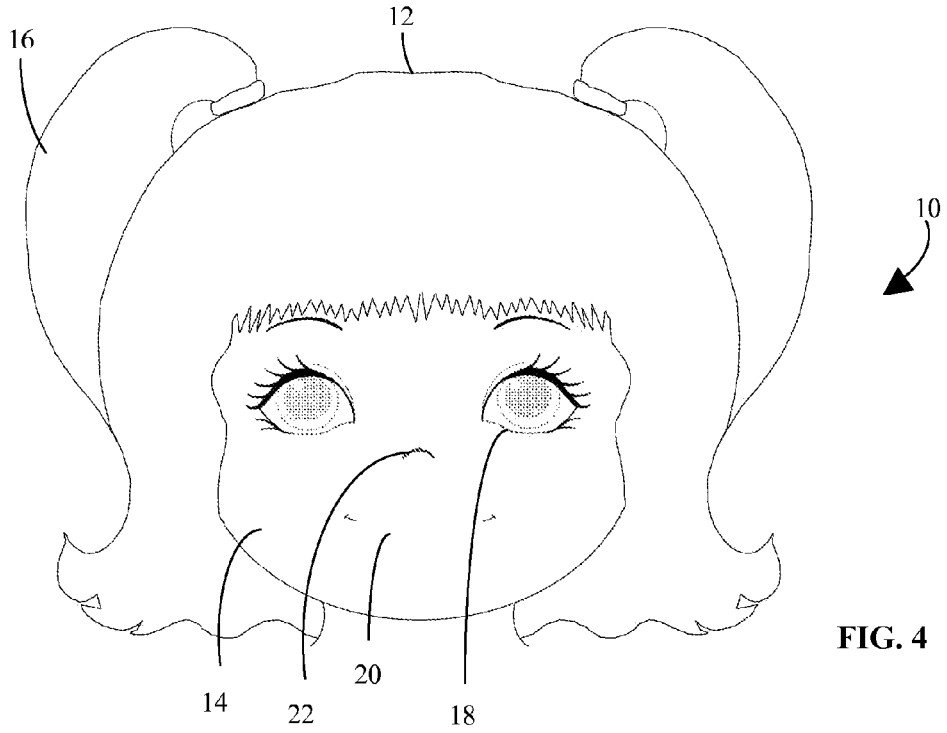
FIG. 4 is a view in front elevation of an alternative lighted doll display device in a dormant condition.
Figure 5:
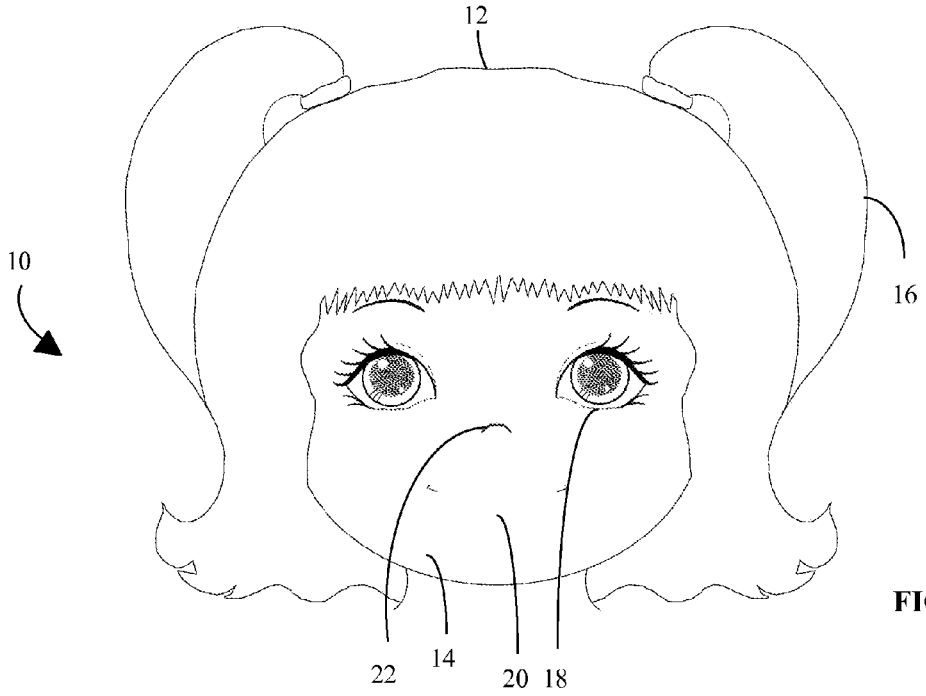
FIG. 5 is a view in front elevation of the lighted doll display device of FIG. 4 in an animated condition.

However, with respect to the animation of the eyes 18, it has been appreciated that some consumers may find it displeasing to view a doll in a dormant state as in FIG. 2, particularly as the lighted doll display device 10 might appear in a retail environment. Accordingly, alternative embodiments of the invention are contemplated, as in FIGS. 4 and 5, where open eyes 18 are applied to the outer surface of the face 14, which is again translucent in the vicinity of the eyes 18. Light provided from behind the eyes 18 as disclosed herein causes the eyes 18 to brighten thereby giving the appearance of an open eye. When illumination is not provided, the eyes 18 have been found to be perceived as closed or blinked despite the fact that there are printed or otherwise applied images of eyes 18 visible. This animation method exploits the great difference in brightness deriving from light illuminating a restricted area.

Figure 6:
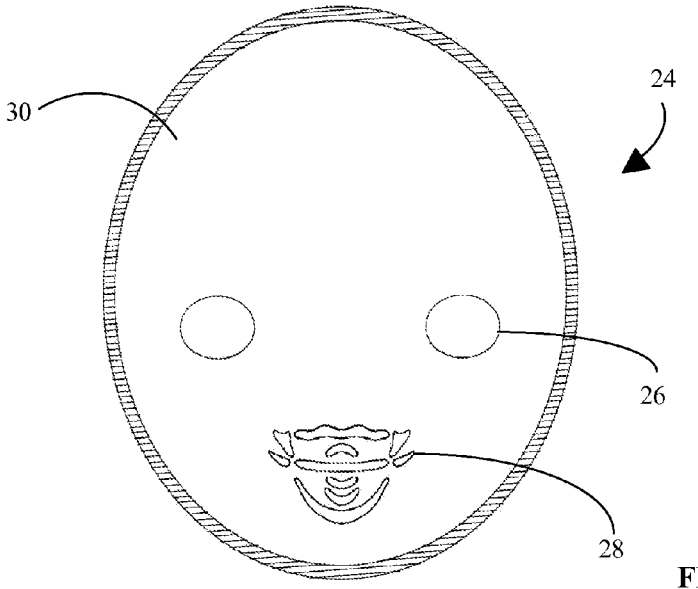
FIG. 6 is a top plan view of a contoured base member.
Figure 7:
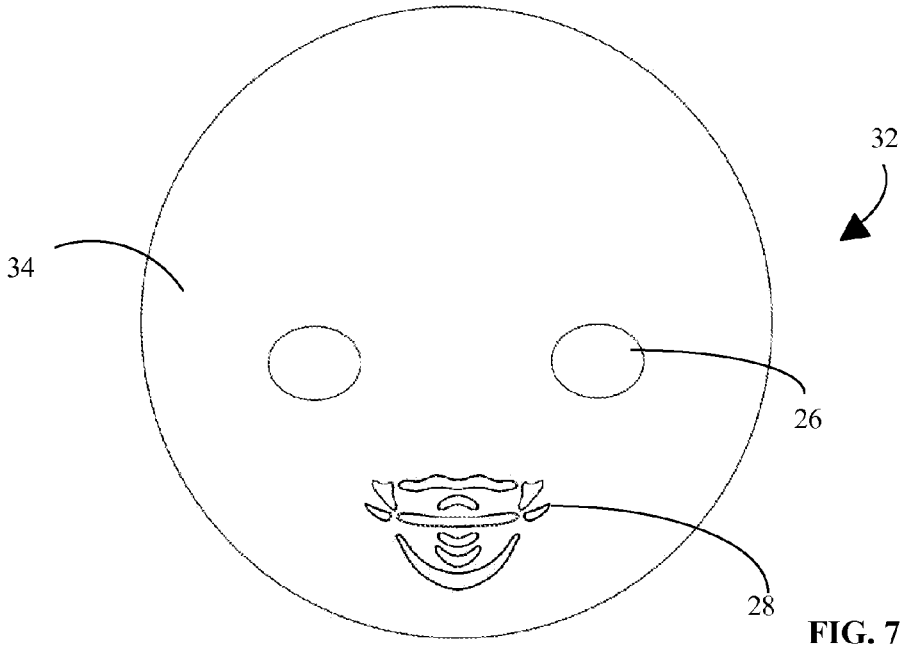
FIG. 7 is a top plan view of a flat base member.

In certain embodiments, the face panel 14 is applied over a three-dimensionally contoured base member 24 with a contoured body portion 30 as shown in FIG. 6, which can be injection molded or formed by any other suitable method. In other embodiments, as in FIG. 7, a flat base member 32 with a flat body portion 34 can be employed. In any case, the base member 24 has left and right eye cavities 26 comprising indentations in the base member 24. Additionally, the base member 24 has what may be referred to as a mouth cavity complex 28 formed therein.

As will be described in detail below, the mouth cavity complex 28 comprises a plurality of distinct and optically separate lip shape configuration cavities, such as those indicated at 28A through 28H in FIG. 8, for providing simulations of the upper and lower lips and potentially other parts of the mouth 20 in varied predetermined configurations. More particularly, lip shape cavity 28A simulates a contoured upper lip, the lip shape cavity 28B simulates a curved lower lip, and the lip shape cavity 28C simulates a curved lip, whether the upper lip, the lower lip, or both. Additionally, the lip shape cavities 28D and 28E simulate pursed upper and lower lips while the lip shape cavity 28F simulates a slightly opened lower lip shape. Finally, the left and right lip shape cavities 28G and 28H simulate an extended lip, whether the upper lip, the lower lip, or both. Of course, the lip shape cavities 28A through 28H could be differently described and, additionally or alternatively, differently configured. The lip shape cavities 28A through 28H are capable of being selectively illuminated to achieve numerous predetermined mouth configurations and a nearly infinite variety of simulated animated talking character depictions.

Figure 14:
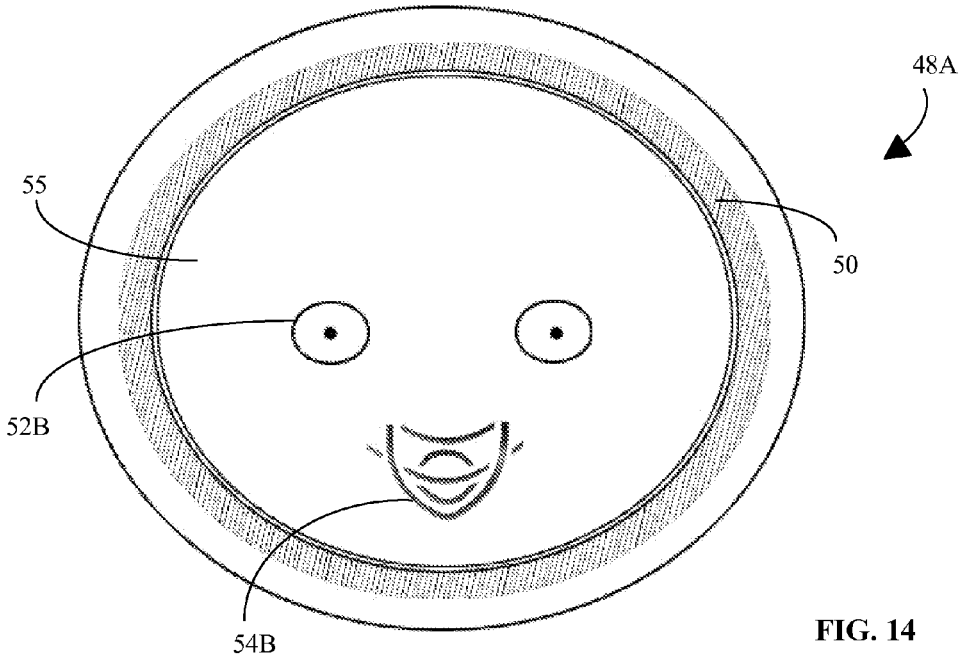
FIGS. 14 and 15 are perspective views of molds for creating base members according to the invention.
Figure 15:
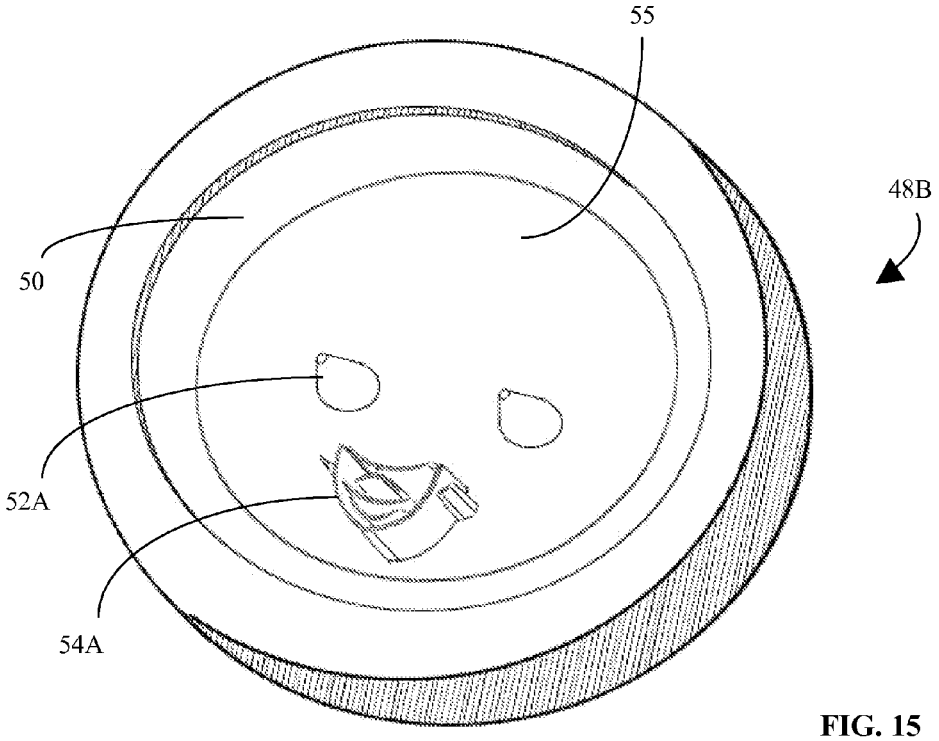

In the flat base member 32, the eye cavities 26 and the mouth cavity complex 28 can be cut in or otherwise formed. In the contoured base member 24, the eye cavities 26 and the cavity complex 28 can be molded in place. As shown in FIGS. 14 and 15, for example, molds 48A and 48B can be employed for molding the base members 24 and 32. As shown, the molds 48A and 48B have a peripheral ridge 50 that defines an outside wall of a face mold surface 55. Eye cavity positives and negatives 52A and 52B and mouth cavity complex positives and negatives 54A and 54B are cut away from the face mold surface 55 for creating the eye cavities 26 and the mouth cavity complex 28.

Figure 11A:
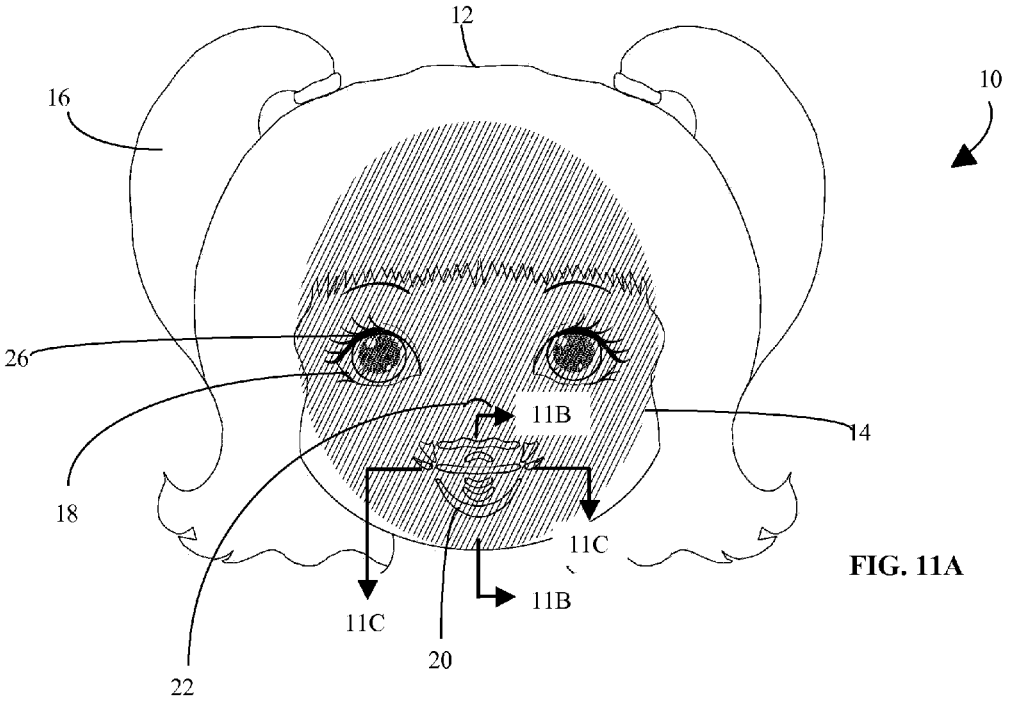
FIG. 11A is a partially disassembled view in front elevation of a lighted doll display device according to the invention.
Figure 11B:
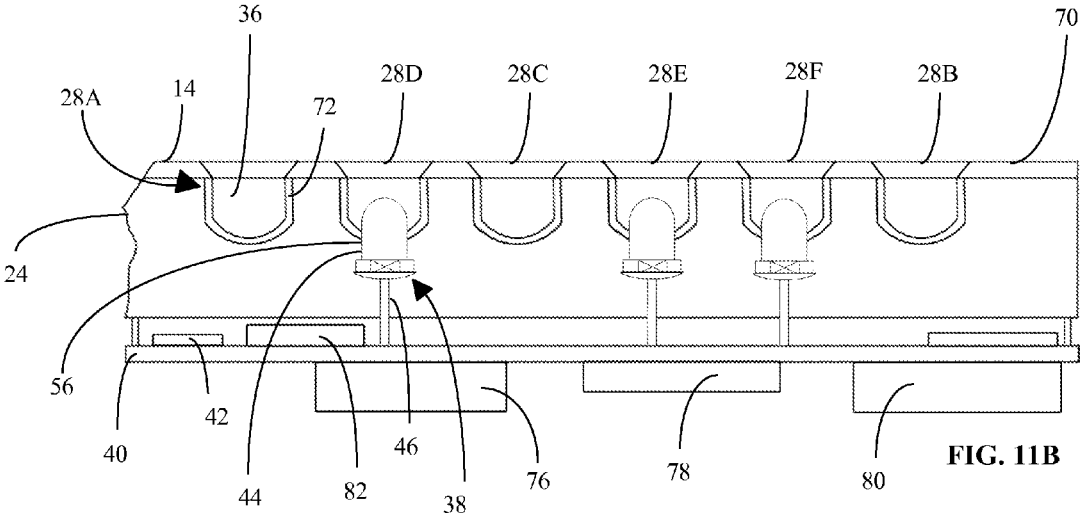
FIG. 11B is a cross-sectional view of the lighted doll display device of FIG. 11A taken along the line 11B-11B.
Figure 11C:
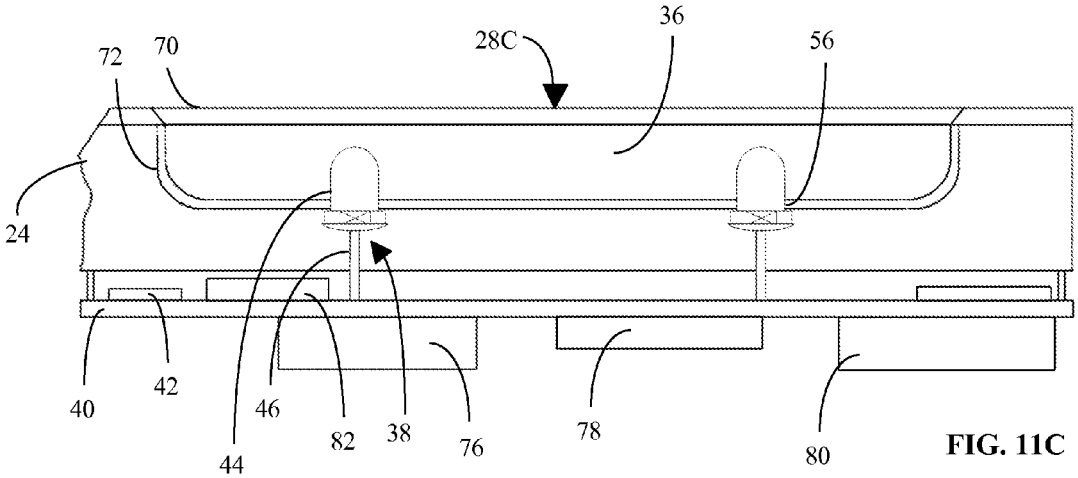
FIG. 11C is a cross-sectional view of the lighted doll display device of FIG. 11A taken along the line 11C-11C.
Figure 11D:
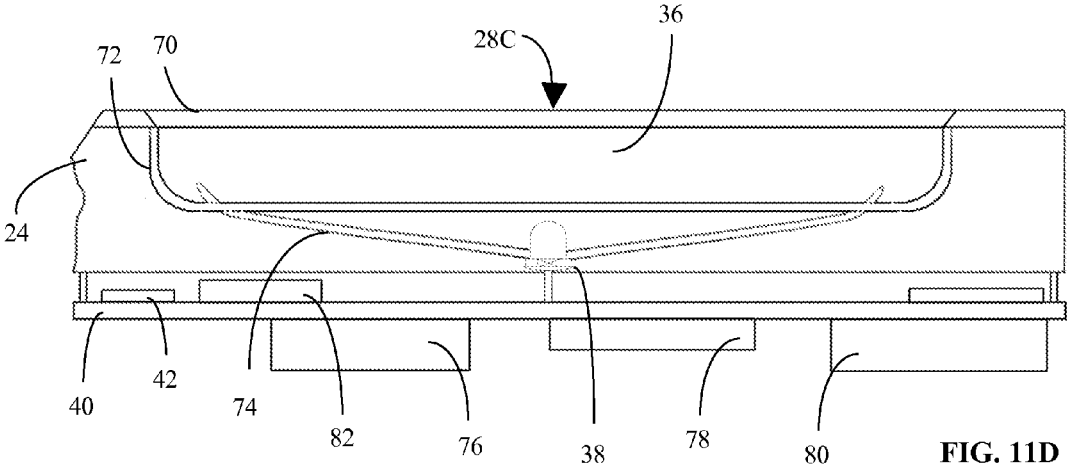
FIG. 11D is a cross-sectional view of the lighted doll display device of FIG. 11A taken along the line 11B-11B in an alternative construction.
Figure 11E:
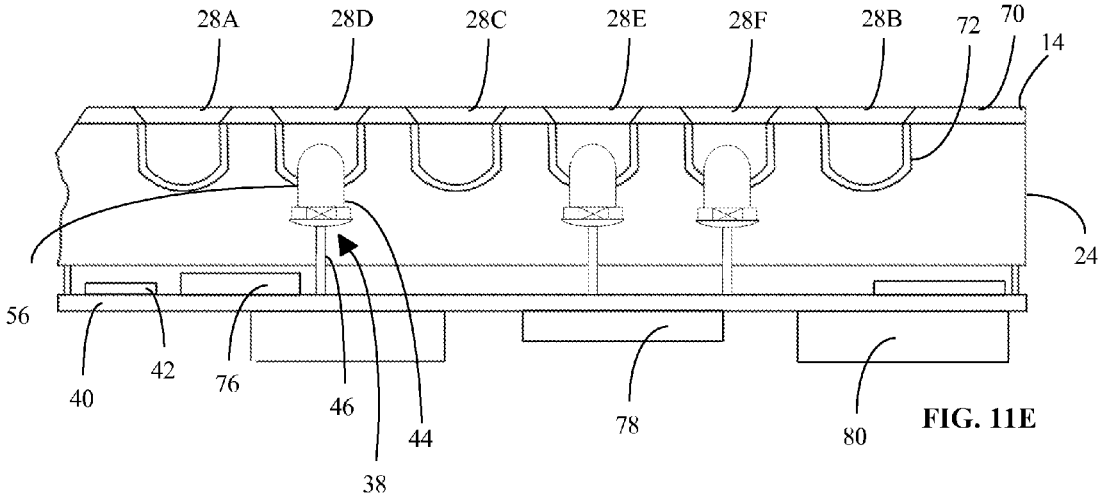
FIG. 11E is a cross-sectional view of an alternative lighted display device pursuant to the invention.

As currently contemplated, the preferred thickness of the base members 24 and 32 is 0.17-0.25 inches when using surface mount LEDs 38 for illumination and 0.5 inches when using 3-5 mm LEDs 38. The preferred material for the base members 24 and 32 will be opaque to prevent light from one cavity 26 or 28A through 28H from inadvertently illuminating another cavity 26 or 28A through 28H. Additionally, a reflective material 72 as shown in FIGS. 11B through 11D will preferably be applied where the material for the base member 24 or 32 is not naturally reflective to a sufficient degree. For example, the cavities 26 and 28A through 28H can be painted bright white or silver for added internal reflectance and enhanced light emission.

Figure 8:
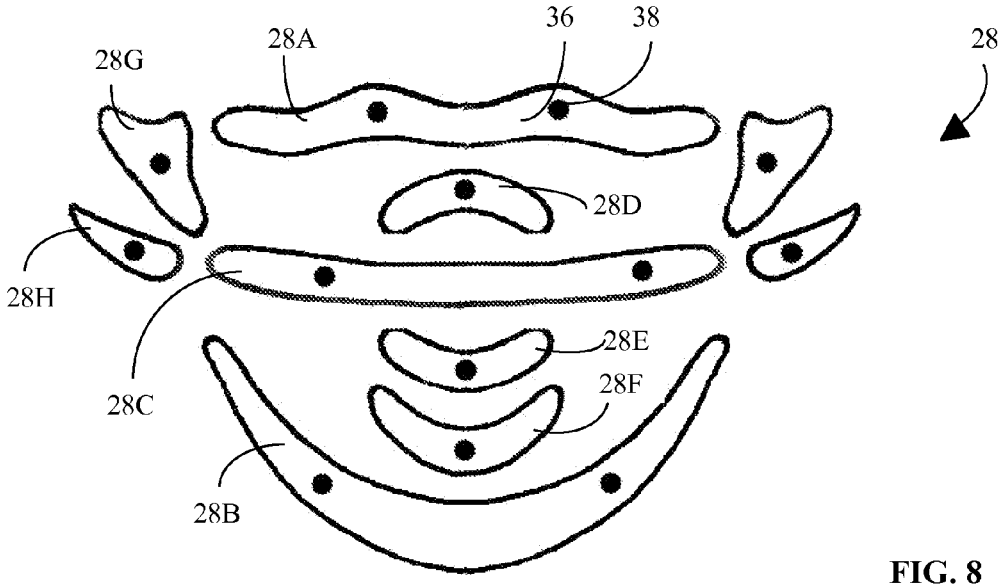
FIG. 8 is a top plan view of an animated mouth cavity configuration as taught herein.
Figure 9:
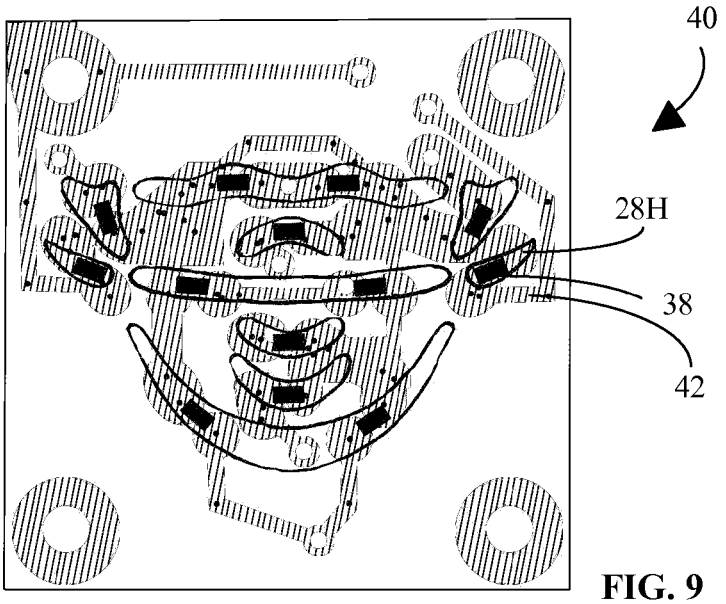
FIG. 9 is a top plan view of a circuit board configuration for use under the present invention.

The illumination of the lighted doll display device 10 can be better understood by combined reference to FIGS. 8 through 12. As shown in FIGS. 8 and 9, each cavity 26 and 28A through 28H has at least one illumination device 38 in optical communication therewith. While other illumination devices 38 may be employed within the scope of the invention except as it might be expressly limited, light emitting diodes (LEDs) are employed as the illumination devices 38 under currently preferred embodiments.

Each cavity 26 and 28A through 28H has at least one LED 38 in optical communication therewith. The optical communication may be carried out directly as by insertion of at least a portion of the lens of the LED 38 into the respective cavity 26 and 28A through 28H as depicted, for example, in FIG. 11B relative to lip shape cavities 28D, 28E, and 28F. Alternatively, embodiments are contemplated where illumination is transmitted to a given cavity 26 or 28A through 28H by use of one or more optical fibers 74 with a first end in optical communication with a light source, such as an LED 38, and a second end in optical communication with a cavity, such as a lip shape cavity 28C as shown in FIG. 11D. It is contemplated to employ optical fibers 74 for transmitting light into the cavities 26 and 28A through 28H with or without optical waveguide material 36 disposed therein.

Advantageously, exploiting multiple optical fibers 74, the invention can permit bright, consistent, and simultaneous illumination in a plurality of cavities 26 and 28A through 28H from a single illumination device 38. Additionally or alternatively, one LED 38 or other illumination device 38 can spread light in multiple locations in a single lip shape cavity 28C using multiple optical fibers 74 as depicted in FIG. 11D. Where optical fibers 74 are employed, their ends will preferably be round-cut so light radiates in a circular pattern from the endpoint of the fiber 74 to maximize the amount of light released into the optical waveguide material 36. This can permit, among other things, multiple shapes or multiple locations in a single shape to be lit simultaneously in the same color by the same LED 38. The shapes can be negative or positive shapes as described herein. Of course, while potentially reducing the number of required light sources 38 and, additionally or alternatively, improving the light display, adding optical fibers 74 necessarily adds the complexity and expense to the manufacturing process required for their provision and installation.

Figure 10:
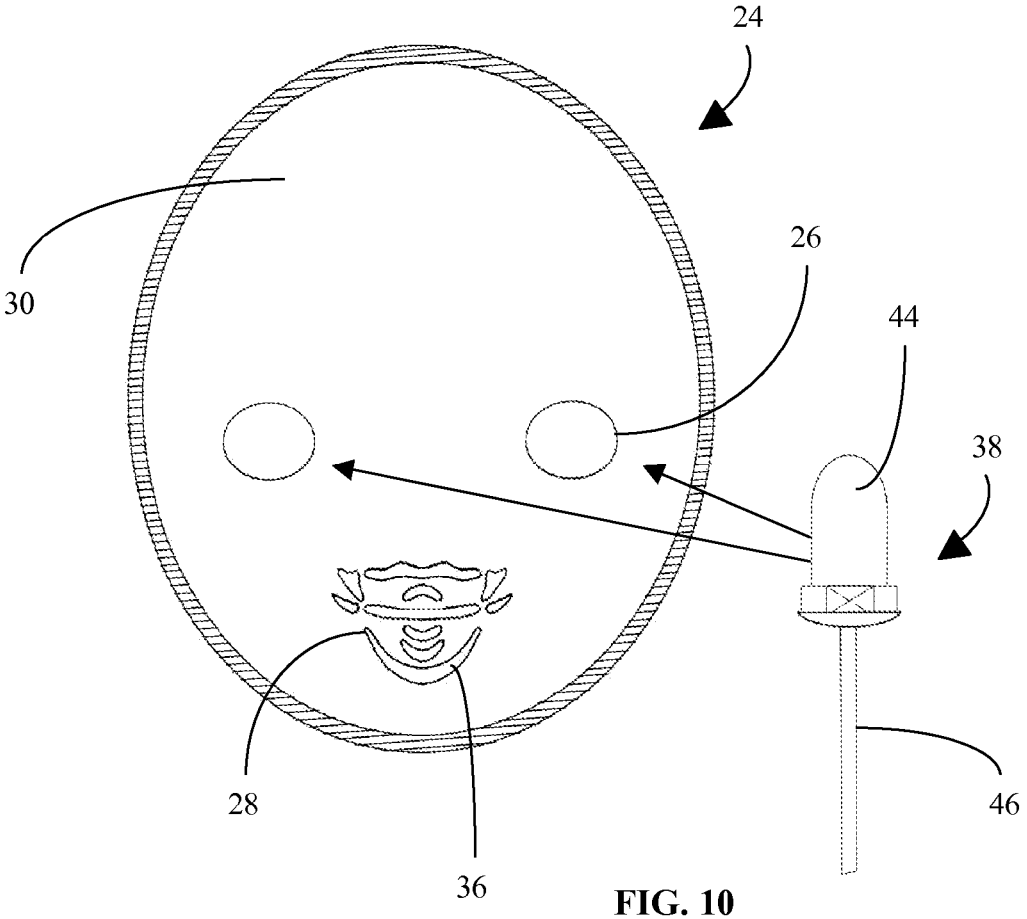
FIG. 10 is a partially exploded and magnified top plan view of a contoured base member pursuant to the invention with an illumination member.

In the depicted embodiment of, for example, FIGS. 8 through 10, each eye cavity 26 is illuminated by a dedicated LED 38 that is in optical communication with the respective cavity 26. Each lip shape cavity 28A through 28H has one or more LEDs 38 in optical communication therewith. More particularly, the lip shape cavities 28D through 28H each have a single LED 38 with a portion thereof directly received into the respective cavity 28D through 28H, and the lip shape cavities 28A through 28C have first and second LEDs 38 received at least partially therein.

Figure 16:
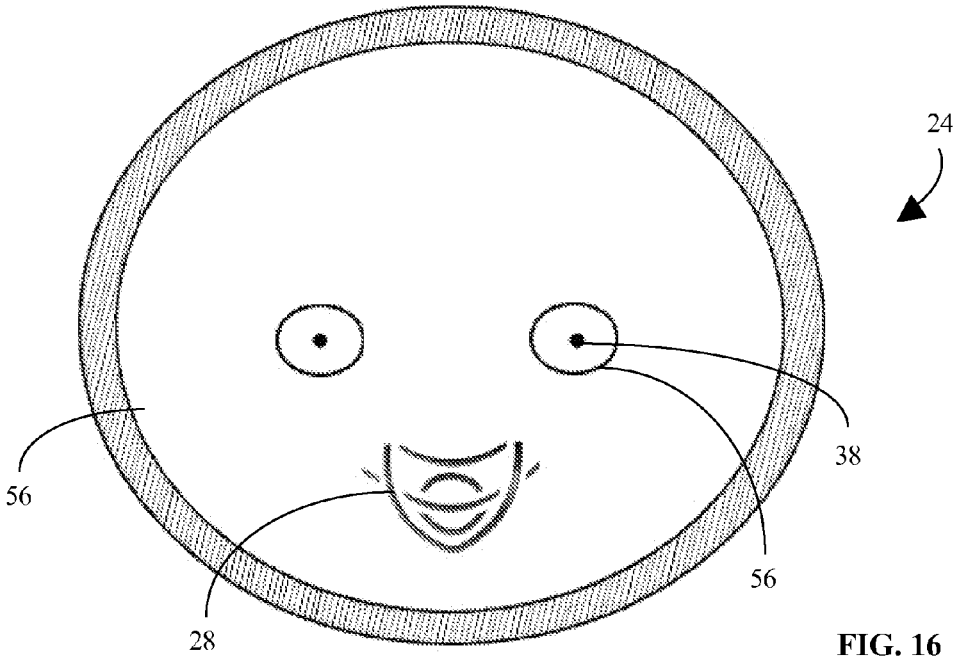
FIGS. 16 and 17 are front and rear perspective views of a contoured base member partially assembled with LED illumination members.
Figure 17:
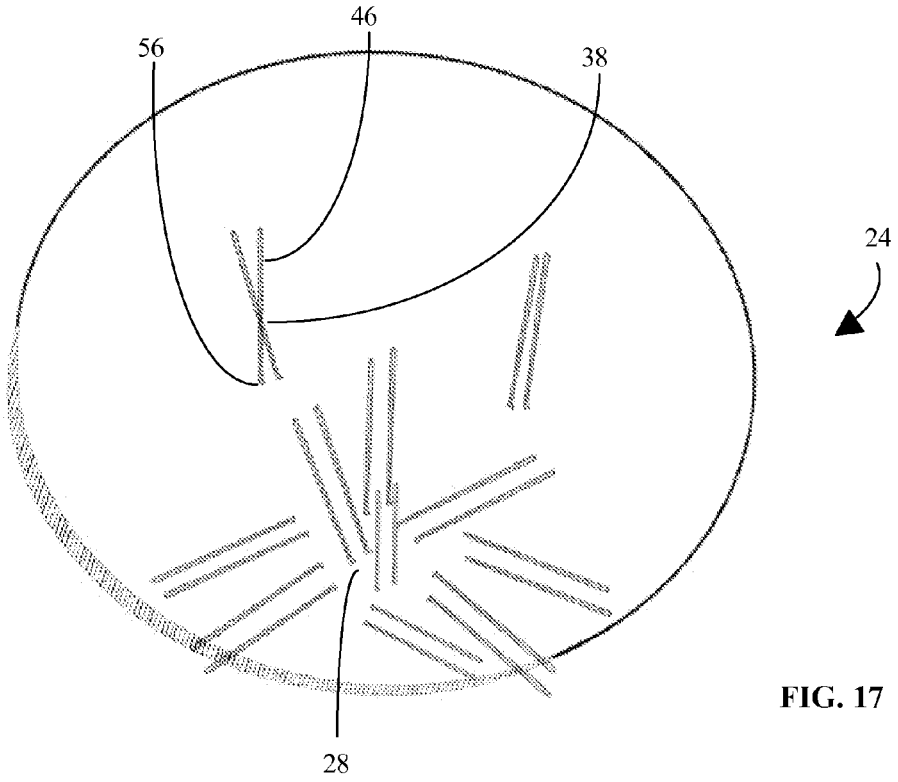

Each LED 38 has a lens 44 with an anode and cathode electrical lead 46. The lead 46 is electrically coupled to a circuit board 40 that has circuitry 42 applied thereto. As seen in FIGS. 11B through 11D, the leads 46 of the LEDs 38 can pass through apertures 56 in the base member 24 as is also shown in FIGS. 16 and 17. Through further assembly, the leads 46 of the LEDs 38 reach the circuit board 40, which can be fastened to the reverse of the base member 24 or otherwise retained. The face panel 14 can include lenses 70 or at least translucent portions overlying the cavities 26 and 28A through 28H for optimizing the visual perception of illumination provided by the lighted toy display device 10.

In one contemplated embodiment, the LEDs 38 used in relation to the eye cavities 26 can comprise 3 mm bulb LEDs 38 soldered to the circuit board 40. The LEDs 38 used in relation to the lip shape cavities 28A through 28H can take the form of hyper-red mini LEDs 38 retained relative to the base member 24 and soldered to the circuit board 40. Additional electronic components, such as an audio speaker 76 for broadcasting utterances corresponding to animations achieved by the eyes 18 and mouth 20, can be secured to the obverse side of the circuit board 40. The speaker 76 is electrically coupled to the circuit board 40, and an activating switch or sensor 78 is operationally connected to the circuit board 40 and to a battery 80 or other power source.

Once actuated, each LED 38 will tend to propagate light within the respective cavity 26 and 28A through 28H. Embodiments of the invention are contemplated wherein the light source 38 is disposed in optical communication with each respective cavity, such as those indicated at 26 and 28A through 28H, with those cavities 26 and 28A through 28H being open inner volumes empty of material disposed therein. Such an embodiment is shown in cross section in FIG. 11E. As noted, such embodiments may be advantageous for their efficiency in manufacture and other characteristics. Where the interior of the negative shape of the cavities 26 and 28A through 28H is highly reflective, whether by material selection of the substrate of the base member 24 or through the coating with a reflective material 72, the light originating from the light sources 38 tends to reflect and re-reflect inside that shape. The translucent material 70 that covers the negative shape of the cavities 26 and 28A through 28H will diffuse the light emanating therefrom in a bright and uniform way without a polymer waveguide 36 present as in other embodiments disclosed herein. Advantageously, constructions without optical waveguide material 36 in the cavities 26 and 28A through 28H have simplified and less expensive manufacturing processes, particularly in designs requiring smaller shapes. Despite the reflection within the cavities 26 and 28A through 28H, however, proceeding with open inner volumes in the cavities 26 and 28A through 28H may require additional light sources 38, particularly in larger shapes, thereby adding complexity and expense in relation to such larger shapes.

Alternative embodiments of the present invention can employ optical waveguide material 36 within some or all of the cavities 26 and 28A through 28H or other three-dimensional shapes and in optical communication with the light sources 38. In certain practices of the invention, the light sources 38 and the waveguide material 36 can cooperate in the production of bright and consistent lighting throughout each cavity 26 and 28A through 28H. More particularly, in certain embodiments of the lighted display device 10, the cavities 26 and 28A through 28H are filled with optical waveguide material 36, which can be polymeric optical waveguide material 36.

Where waveguide material 36 is incorporated, the insertion of the optical waveguide material 36 can preferably be carried out after the LEDs 38 have been caused to protrude into the cavities 26 and 28A through 28H. When the cavities 26 and 28A through 28H are then filled with the optical waveguide material 36, the protruding portions of the LEDs 38 will be encapsulated within the optical waveguide material 36.

The preferred polymeric optical waveguide material 36 will have a refractive index of 1.4 or more. Moreover, prior to hardening, the optical waveguide material 36 will preferably be of a low viscosity so that any bubbles included on initial pouring will rise to the surface for removal prior to hardening. The absence and, if necessary, removal of any interstitial bubbles and direct contact between the polymeric optical waveguide material 36 and the LEDs 38 is considered important to ensuring uniform lighting where waveguide material 36 is employed. Except as might be required for other purposes, the preferred optical waveguide material 36 is optically clear. The optical waveguide material 36 and the reflective walls of the cavities 26 and 28A through 28H will tend to propagate and reflect light throughout each cavity 26 and 28A through 28H to provide bright and consistent illumination.

Embodiments of the present invention employing polymer waveguides 36 with light sources 38 placed in or behind a negative shape cavity 26 and 28A through 28H and clear plastic waveguide material 36 in fluid form poured into the cavities 26 and 28A through 28H to encapsulate the LEDs 38 can be seen to have advantages and disadvantages. On the positive side, the polymer waveguides 36 tend to diffuse light within the cavities 26 and 28A through 28H in a bright and uniform way. On the negative side, however, the addition of polymeric waveguide material 36 to the cavities 26 and 28A through 28H requires additional expense and adds complexity to the manufacturing process, including the accommodation of curing time and, potentially, the need for heat for curing. Additionally, the present inventors have found that at least the initial polymers tested showed an unpredictable tendency to become cloudy and to form bubbles. Both attributes cause problems with light diffusion, which is a fundamental goal of the invention. Were these challenges to be solved in a cost effective manner, the polymer waveguide material 36 would be still more desirable.

Figure 11F:
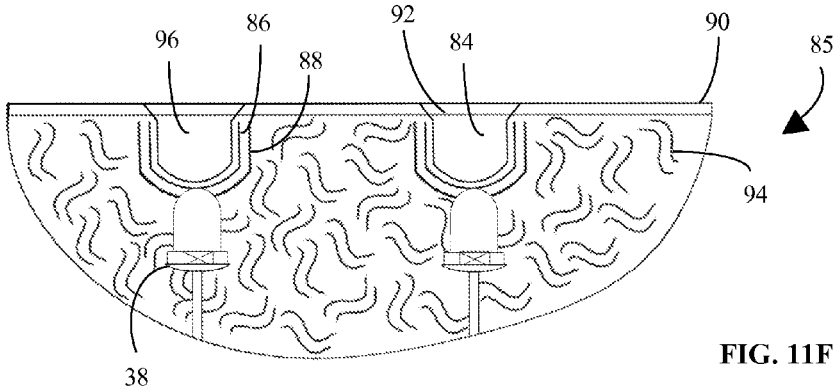
FIG. 11F is a cross-sectional view of still another lighted display device as taught herein.

Looking to FIG. 11F, an alternative embodiment of the display device is indicated at 85 wherein separate, positively shaped translucent or transparent light emitting members 84 and 96 are lit by light sources 38 to produce a shaped design, which can be static or animated. The light emitting members 84 and 96 can be transparent or translucent and can again be formed from a polymeric material. The light sources 38, again comprising LEDs in the depicted embodiment, are disposed in optical communication with the light emitting members 84 and 96, ideally in direct contact therewith or with the ends of optical fibers in direct contact therewith where such fibers are employed. To facilitate internal reflection and light emission from the light emitting members 84 and 96, the side and back portions of the light emitting members 84 and 96 can be enveloped, such as by coating, with a highly reflective layer 86 while the outwardly facing surface of the light emitting members 84 and 96, or at least the portion thereof from which light is designed to be emitted, will be left bare.

Where necessary for optimal reflection and emission of light, the reflective layer 86 can additionally be coated with another layer 88 of opaque material. The reflective material layer 96 and, where applied, the opaque material layer 88, effectively recreate the performance of the opaque, reflective walls of the cavity 26 and 28A through 28H. Because the positive shapes of the light emitting members 84 and 96 do not require for proper light emission a structure to retain them, they can be placed with more freedom inside an item. This can be particularly advantageous in soft items where the light emitting members 84 and 96 would otherwise be difficult to employ and retain. As shown, the light emitting members 84 and 96 can be embedded in batting 94 or another material and potentially covered by an overlying layer 90, which can be translucent or can at a minimum have transparent or translucent portions 92 overlying the light emitting members 84 and 96.

Advantageously, the light emitting members 84 and 96 will tend to diffuse light throughout their shape in a uniform manner, with little loss of brightness. Of course, molding and coating the light emitting members 84 and 96 and properly associating them with LED light sources 38 require associated processes and add manufacturing expense. Additionally, placing and retaining the light emitting members 84 and 96 in predetermined locations without shifting within a soft substrate can be a challenge. Therefore, it is preferred that the design of the overlying layer 90 not require exact registration between any printed design and the underlying lit area.

Figure 11G:
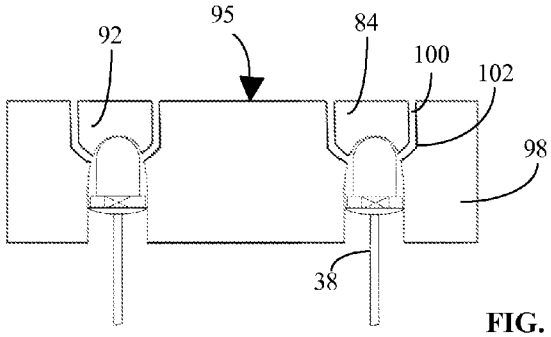
FIG. 11G is a cross-sectional view of a further lighted display device according to the invention.

Still further, it is possible within the scope of the invention to provide a display device 95 as shown in FIG. 11G where positively shaped light emitting members 84 and 92, which again can be of clear or translucent polymeric or other material, are disposed in a base member 98 with similarly shaped negative cavities 100, which can be coated with a reflective material 102. A light source 38, which again can comprise an LED light source 38, can be placed in or behind each negative cavity 100. The positive shapes of the light emitting members 84 and 92 will preferably be in direct contact with the light sources 38 within the respective negative cavities 100 and will preferably also be in direct contact with the wall surfaces of the negative cavities 100.

Advantageously, under the embodiment of FIG. 11G, the negative cavities 100 will be coated with a layer of reflective material 102 or will otherwise be highly reflective. Therefore, coating the sides and bottom surfaces of the light emitting members 84 and 92 is rendered unnecessary. The light emitting members 84 and 92 will diffuse the light throughout their respective shapes in a uniform manner with little loss of brightness. However, it will be recognized that molding and placing the light emitting members 84 and 92 in proper relation to a light source 38 require at least two additional process steps.

Figure 18A:
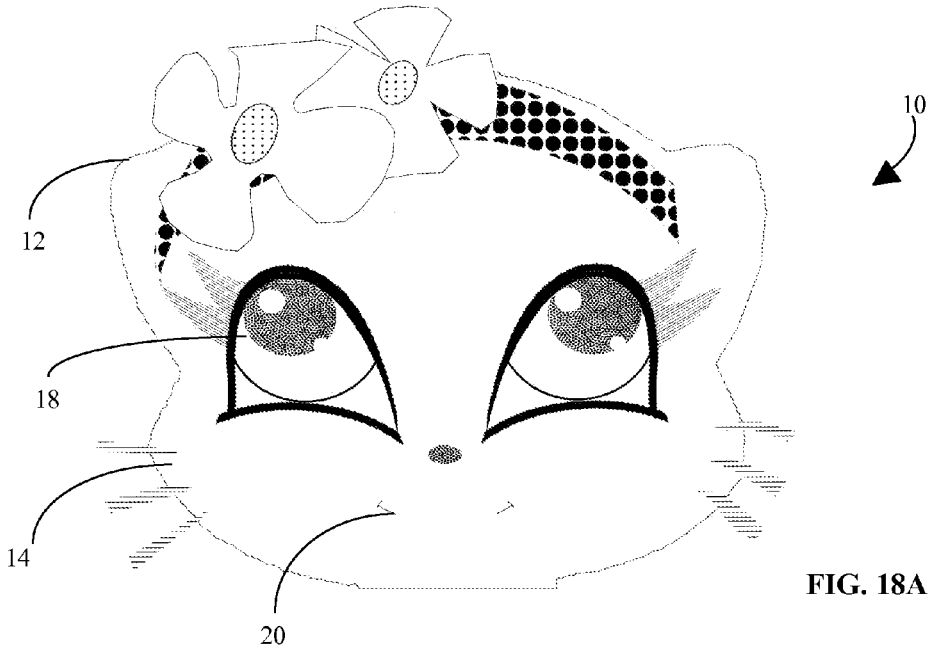
Figure 18B:
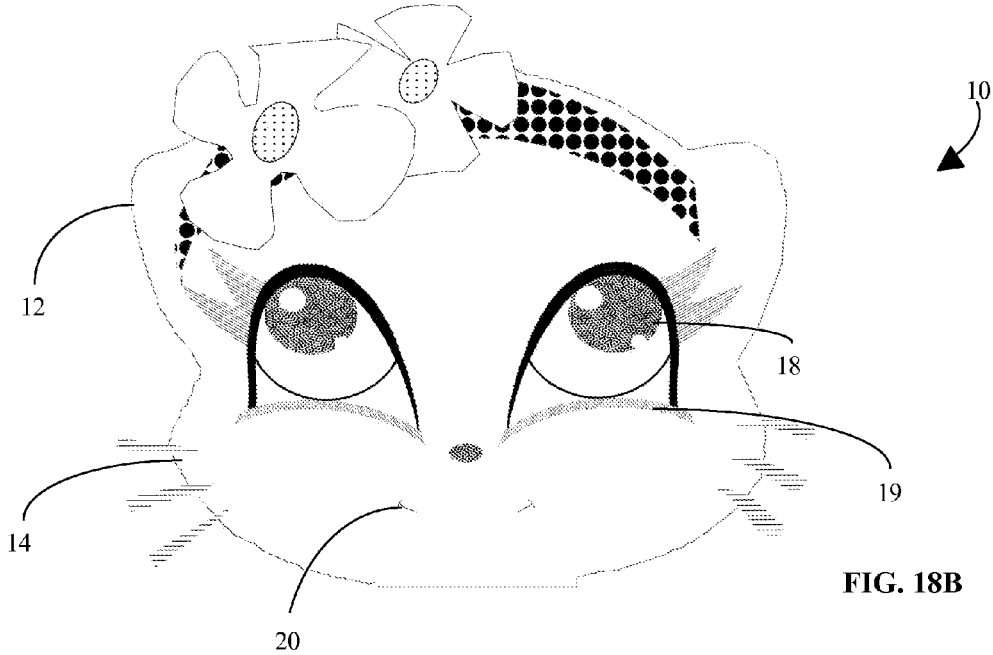
Figure 18C:
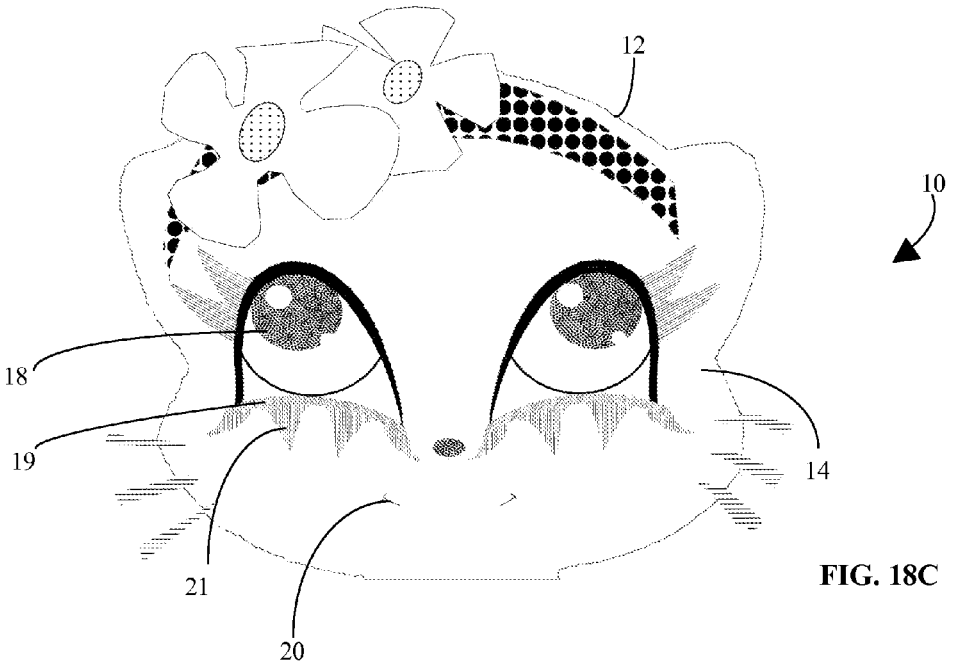
Figure 18D:
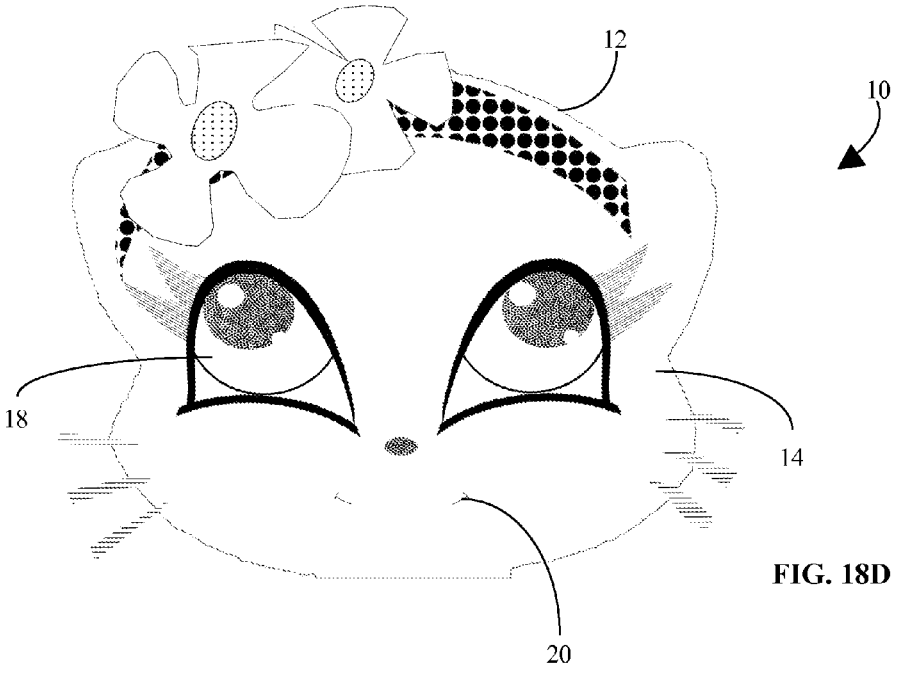

It will be appreciated that additional or different eye and lip shape cavities 26 and 28A through 28H would readily be employed under the invention to produce additional and different animation effects. For example, looking to the further embodiment of the invention shown in FIGS. 18A through 18E, additional eye animation effects can be achieved by, for example, having a primary eye illumination 18, a proximal lower eye illumination 19, and a distal lower eye illumination 21, and an upper eye illumination 23. With this, an off condition leaves all illumination off so that the viewer has the perception of dormancy as in FIG. 18A. Illumination of the proximal lower eye illumination 19 gives a first perception of blinking as in FIG. 18B, and illumination of both the proximal and distal lower eye illuminations 19 and 21 gives an alternative perception of blinking as in FIG. 18C. Still further, illuminating the primary eye illumination 18 gives the perception of the eyes 18 being active or open as in FIG. 18D, and illuminating both the primary eye illumination 18 and the upper eye illumination 23 gives an alternative perception of the eyes 18 being open and active.

In view of the foregoing, it will be appreciated that the cavities 26 and 28A through 28H comprise negative shapes formed within the reflective, opaque material of the base members 24 and 32 or within opaque, reflective cavities 26 and 28A through 28H formed by applying opaque, reflective coating 72 if the forming material is not naturally reflective or opaque. LEDs 38 are placed within or behind each cavity 26 and 28A through 28H so that light from each LED 38 is dedicated to cavity 28 or 28A through 28H and does not radiate into any other cavity 28 or 28A through 28H. The open inner volume or, where employed, the optical waveguide material 36 is disposed just beneath a translucent surface 14 so that illumination tends to display through the surface 14.

An unlimited variety of display devices 10 could be created within the scope of the invention. In each case, the light design will be produced from the light sources 38 within the negative shapes and onto the translucent surface 14 using directly-lit or back-lit structures or a combination of both. Light designs may be considered to be static when LEDs 38 within a negative shape are simply attached to a power source for illumination. Light designs are considered to be animated when more than one negative shape is used and LEDs 38 within these negative shapes are controlled by a circuit board 40 and computer programming so that the cavities 26 and 28A through 28H are lit in a given pattern, which can be a series of illuminations, a sequence of illuminations, a plurality of illuminations, or any combination thereof. Where animated designs are employed, they can be used to illustrate a story. In the depicted example, the several independently illuminated cavities 26 and 28A through 28H can produce an animated talking character with an animated face 14 with a mouth 20 that forms words and eyes 18 that blink.

The surfaces of the cavities 26 and 28A through 28H and the surface 14 will preferably be selected and applied for optimally consistent and bright illumination. In one practice, LEDs 38 can be disposed in or behind a negative shape as described above. The cavities 26 and 28A through 28H can be left as open inner volumes. Alternatively, a clear or, at minimum, translucent plastic or other material positive of that shape can be inserted into the negative cavity to act as optical waveguide material 36. When used, the positive shaped optical waveguide material 36 will preferably touch the LED 38 in the negative shape and the walls of the negative shape. The LEDs 38 can be placed in or behind a negative shape as described above, and liquid material can then be poured into the shape to encapsulate the LEDs 38 to act as an optical waveguide material 36. The open inner volume or the plastic or other optical waveguide material 36 can then be covered with a translucent material 14, which can include optical lenses 70 as described above.

In producing a display device 10 according to the invention for use in dimensional areas and some flat areas, the method can employ one die 48 and two filling steps. The die 48 is created with shapes that are the positive shape of a desired design. A first fill is in the die 48 to create a base-mold 30 that includes cavities 26 and 28 representing the negative of the desired design, which in the current example is a face. The cavities 26 and 28 can be left open to form open inner volumes. Alternatively, a second fill can be carried out using a transparent, flexible polymer to fill the cavities 26 and 28 in the base-mold 30 to creating waveguides 36 that are the positive shape of the desired design.

In some areas, depending on variables including size and material, a simple cut or stamp and fill process can be used. The cuts or stamps become cavities 26 and 28 that represent the negative of a desired design. Once these cavities 26 and 28 are inserted into a material, the material may then be considered a base-material 30. The cavities 26 and 28 in the base-material 30 can be left open or filled with a transparent, flexible polymer to create waveguides 36 in the base-material 30 that are the positive shape of the desired design. A wide variety of flexible or rigid materials can be used for the base mold or base-material 30. Likewise, any molding process can be used to create the cavities, including gravity molding, injection molding, or roto-molding. In the cut or stamp and fill method, any cut or stamping method to create the cavities 26 and 28, such as die-cutting, laser cutting, wire-EDM, and any other suitable method, can be employed.

Where it is employed, the optical waveguide material 36 can comprise a transparent, flexible polymer, such as polydimethyl siloxane (PDMS) in liquid or gel form, to enable low cost molding or injection-molding of optical waveguides 36 to effect displays that are viewed as static or animated light designs. When LEDs 38 are used as the light source, they can be added to the cavities 26 and 28 in the base-mold or base-material 30 before filling with the PDMS-type material 36 to ensure that the LEDs 38 are embedded in the waveguide material 36 as it hardens and are fixed in a position that has been predetermined to be optimal.

An animated design condition can be achieved when at least two light sources 38 are connected to a processor 82, whether directly, wirelessly, or otherwise. On and off blinking or sequencing of the LEDs 38 or other light sources 38 produces moving light designs, such as hearts beating, flowers blooming, and any other design, including a specialized design condition disclosed herein that can be referred to as an animated talking character. Using the processor 82, the speaker 76, and other means, the lighted display device 10 can synchronize sound to the perceived motion achieved by the sequenced light sources 38. Using the invention, light designs can be made of light lines as well as light points, and backlighting can be incorporated into light designs without any structural additions.

Continuing with the concept of an animated talking character, one can begin with a machine or injection molded a base mold 30, which can preferably be made of PDMS-type material. The base-mold can be opaque, whether initially or through the addition of a coloring agent. A negative is provided for the photo-optical display for the face 14. White LEDs 38 can be used in the eyes 18, and red LEDs 38 can be used in the mouth 20. Other colors can be used for eyebrow channel-lines and other elements. The placement of the light sources 38 can come from the back of the mold. The cavities 26 and 28 can be left open or filled with waveguide material 36, which can be transparent PDMS-type material. That waveguide material 36 can then be cured, such as at room temperature for 24 hours or at 60° C. for 1 hour, thereby embedding the LEDs 38 into the PDMS-type material 36. The light sources 38 are connected to the processor 82, speaker 76, and the battery 80 or other power source. The fabric or other face panel 14 can be mounted over the base mold 30 with translucent or transparent portions overlying some or all of the cavities 26 and 28.

Figure 20:
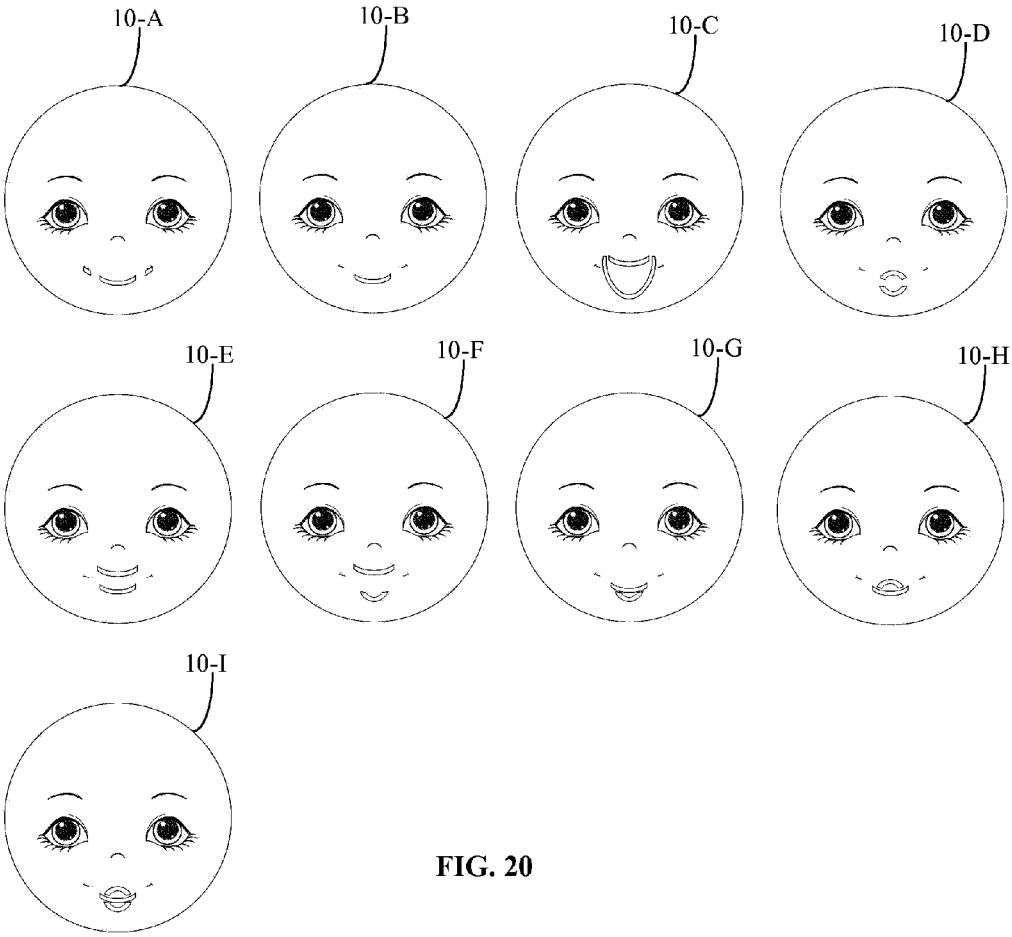
FIG. 20 provides a series of views in front elevation of various animation conditions of the lighted doll display.
Figure 21:
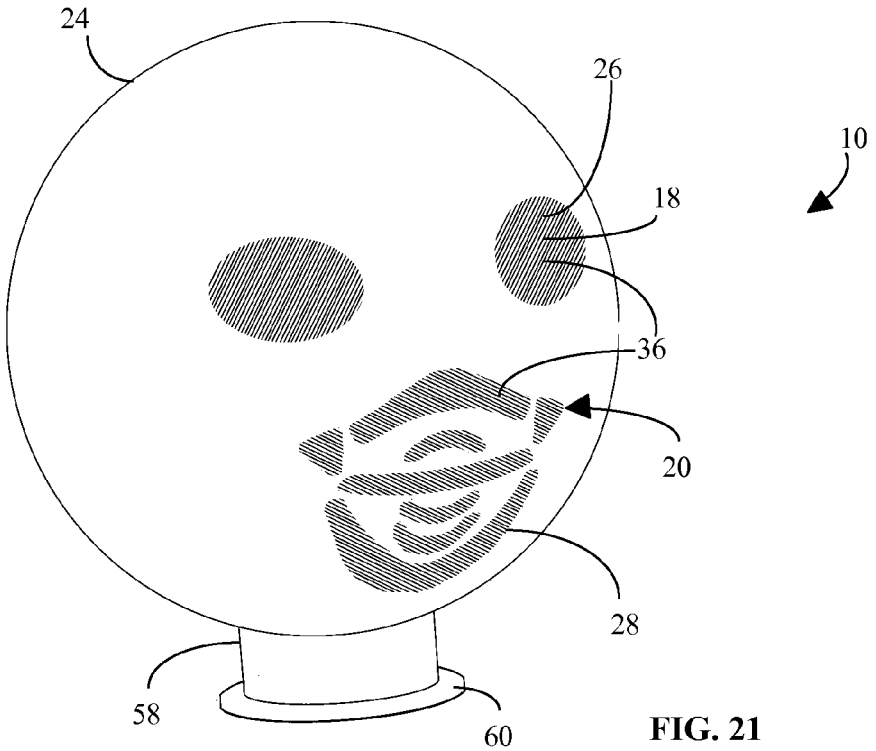
FIG. 21 is a perspective view of an alternative lighted doll display pursuant to the present invention.
Figure 22:
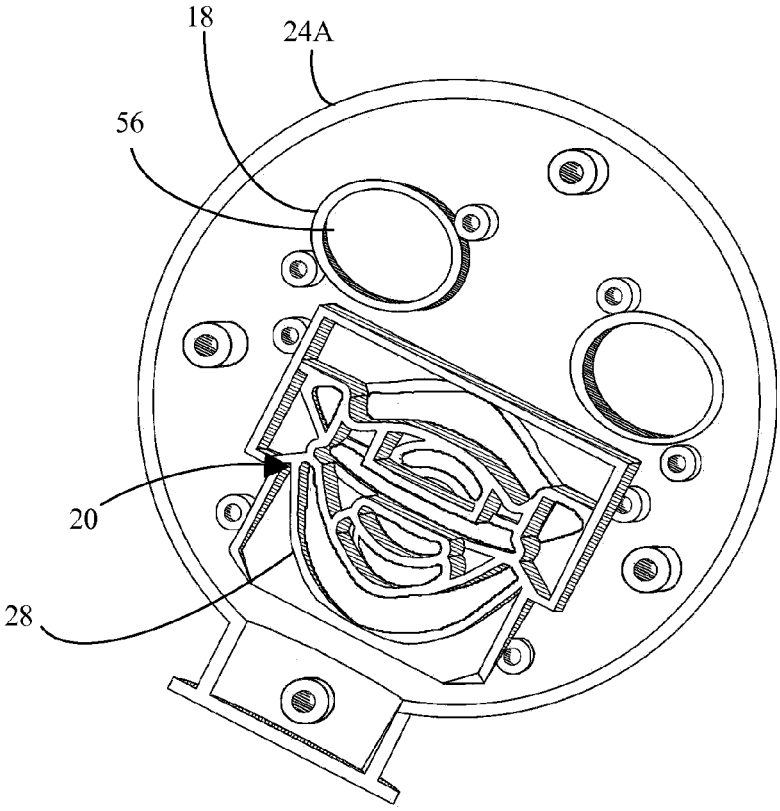
FIG. 22 is a rearward perspective view of an anterior contoured base member from the lighted doll display device of FIG. 21.
Figure 23:
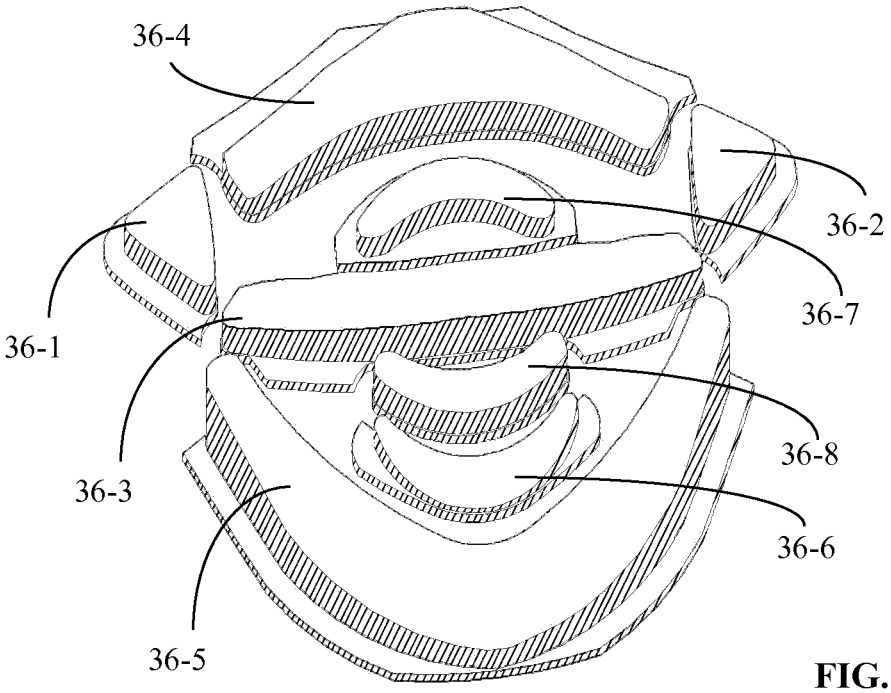
FIG. 23 is a perspective view of a waveguide material complex for use with the anterior contoured base member from the lighted doll display device of FIG. 21.
Figure 24:
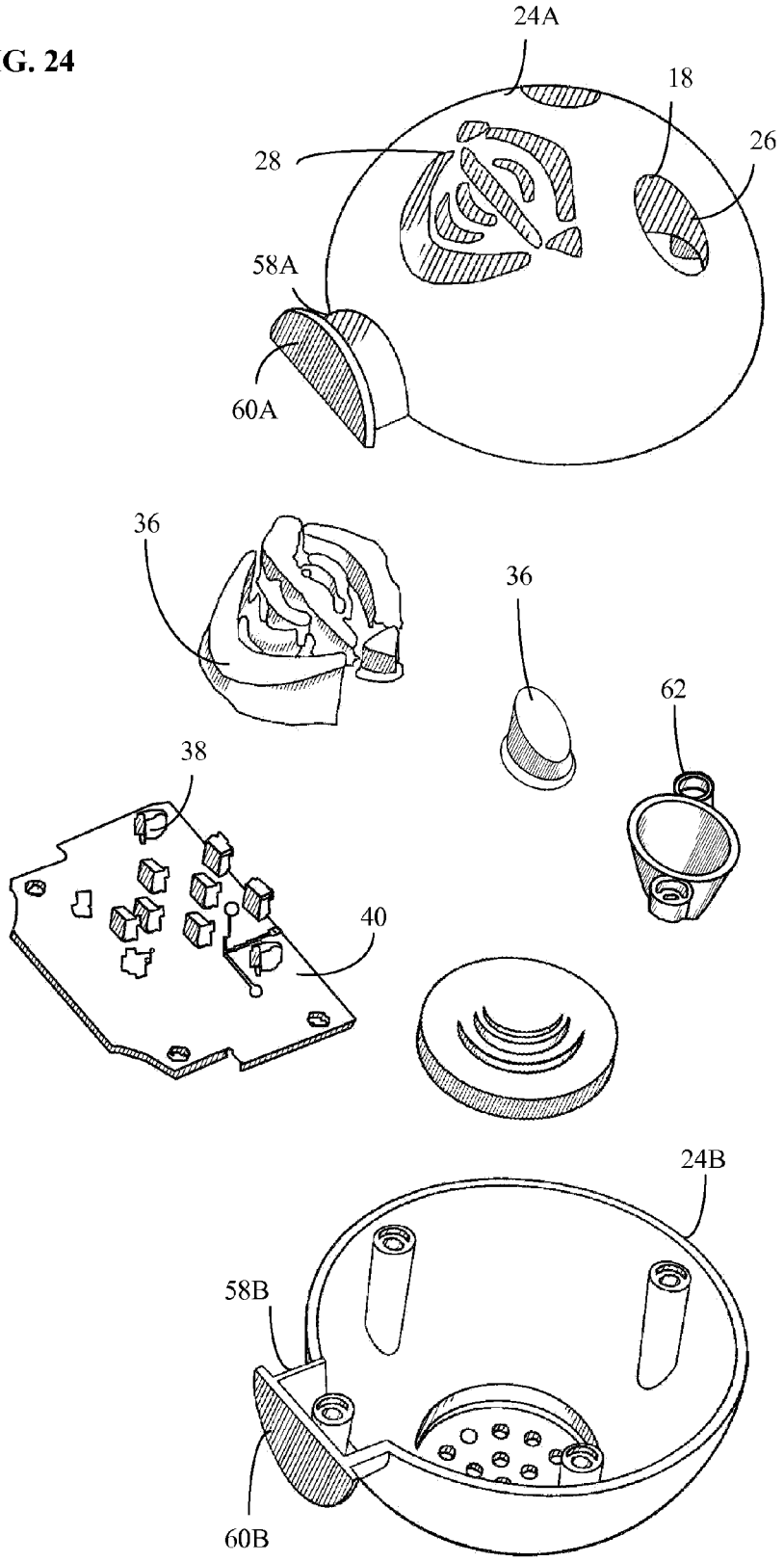
FIG. 24 is an exploded perspective view of the lighted doll display device of FIG. 21.

Through suitable programming, the LEDs 38 for the eyes 18 can blink and produce the lighted effect of a person's eyes blinking as described above. Programming for the on and off sequencing of the LEDs 38 in the mouth cavity complex 28 produces the lighted effect of a person's mouth changing shape as it speaks or sings words or sounds. The illusion of speech is achieved by creating a program that alternates the lighting of mouth shapes to simulate the way a mouth moves when speaking Correct timing and coordination of lighting and sound can produce convincing animation and simulated utterances. As shown in FIGS. 19 and 20, through the configuration of the several lip shape cavities 28-1 through 28-7 in combination with the selective lighting of the corresponding LEDs 38-1 through 38-9, the mouth 20 can be caused to have the appearance of uttering nearly any sound and of smiling, grinning, and otherwise animating.

A further embodiment of the lighted display device 10 in the form of a head, which can again be a doll head or some other type of animated head, is depicted in FIGS. 21 through 24. The display device 10 has a contoured base member split into first and second halves 24A and 24B. A neck 58 and flange 60 allow retention relative to a body (not shown), and are separable into neck halves 58A and 58B and flange halves 60A and 60B. An eye aperture 56 can receive a waveguide material 36, and eye sockets 62 serve to focus illumination further. The waveguide material 36-1 through 36-8 is received in corresponding apertures to form the mouth 20.

Figure 25:
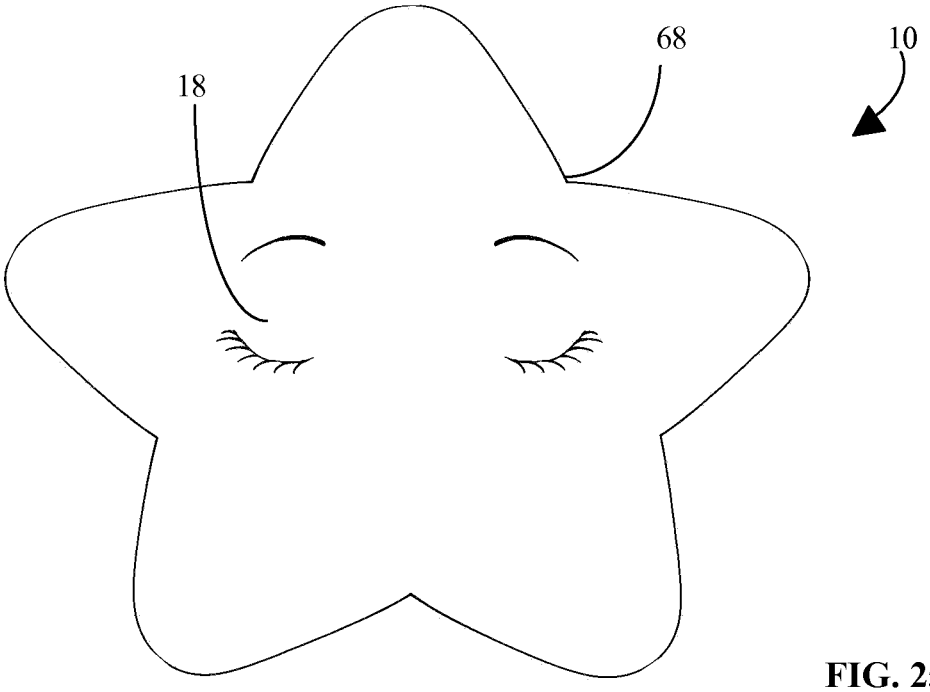
FIGS. 25 and 26 are top plan views of an alternative lighted display device according to the invention in the form of a star in dormant and animated conditions.
Figure 26:
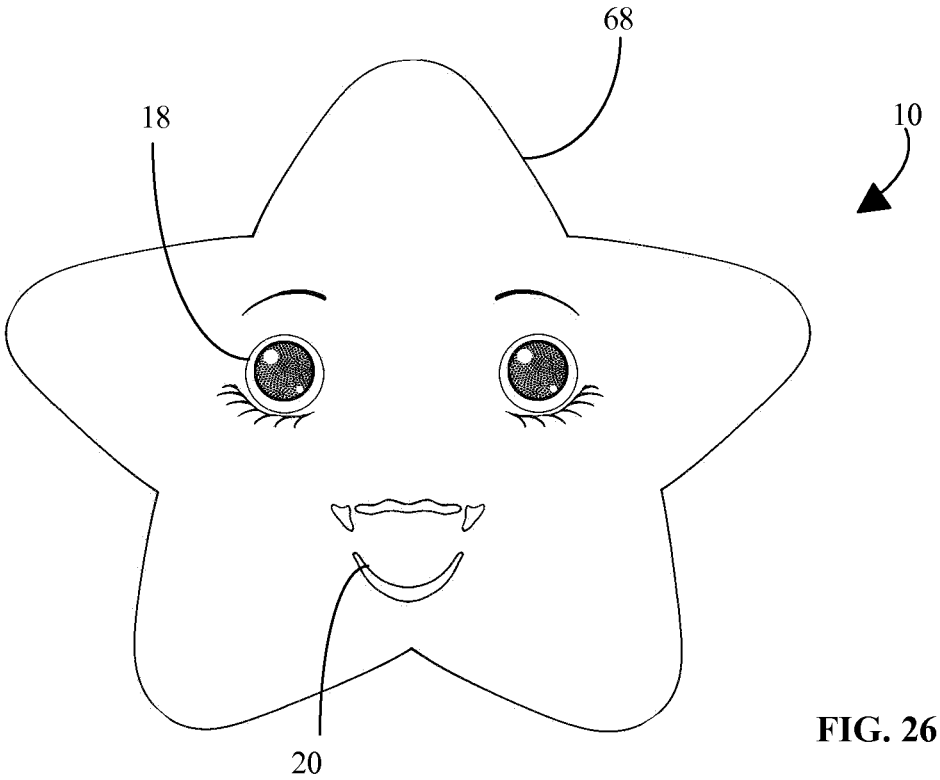
Figure 27:
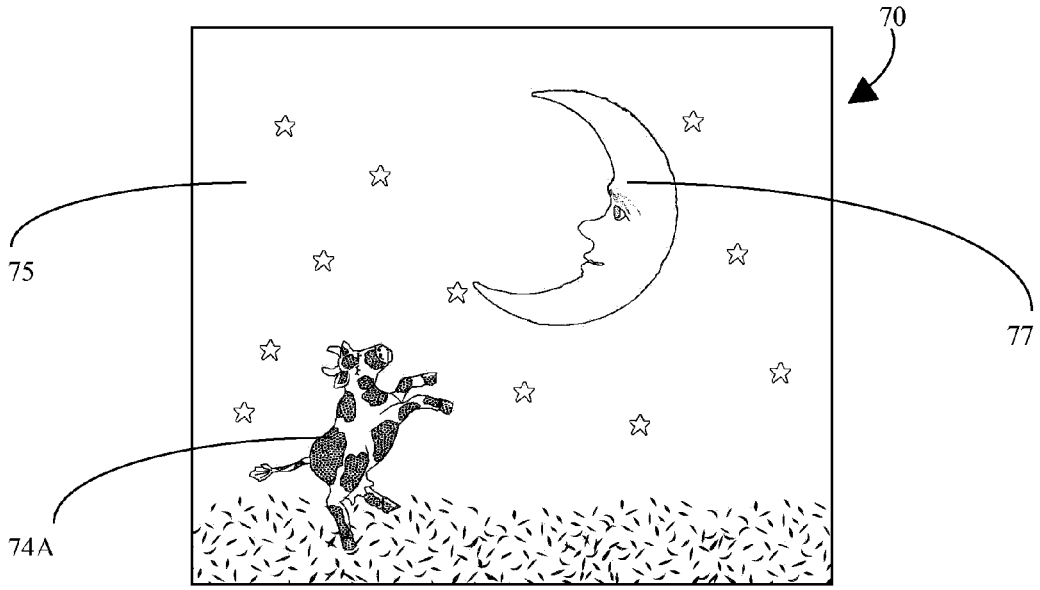
FIGS. 27 and 28 are views in front elevation of another alternative lighted display device pursuant to the invention in the form of an animated artwork display device in first and second animation conditions.
Figure 28:
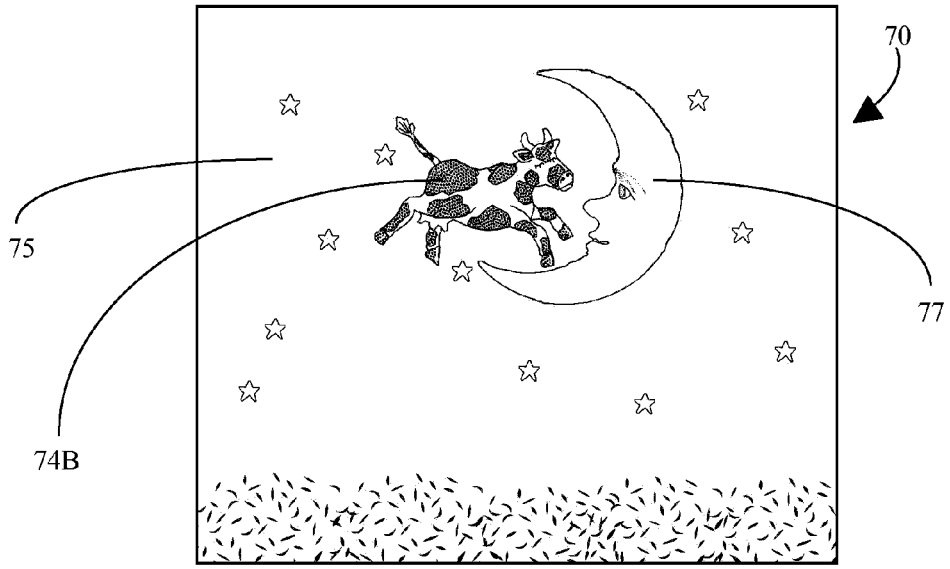

Of course, the lighted display device 10 can take numerous different forms. As shown in FIGS. 25 and 26, a lighted star display device 10 can have a star-shaped body 68 again having eyes 18 and a mouth 20 capable of animation as described herein. Still further, in FIGS. 27 and 28, lighted artwork display devices 70 are contemplated where a background 75, which can be illuminated or not, is depicted in relation to an illuminated cow 74A and 74B that jumps over an illuminated moon 77, all as taught hereunder.

With certain details of the present invention for a lighted display device 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. An illuminated display device comprising:

a base member with a surface;

a plurality of cavities in the base member wherein each cavity has a wall surface and a cavity opening contiguous with the surface of the base member;

a plurality of illumination devices wherein at least one illumination device is disposed in optical communication with each cavity for providing illumination within the cavity and for emitting light through the opening;

means for illuminating the at least one illumination device disposed in optical communication with each cavity to illuminate the cavity and to emit light through the opening to provide an illuminated display;

means for causing the plurality of illumination devices to illuminate in a pattern;

wherein the illuminated display device comprises an animated talking character with a plurality of cavities that form an animated mouth cavity complex with multiple predetermined mouth lighting configurations established by selective illumination of the illumination devices in optical communication with the cavities forming the animated mouth cavity complex, wherein the animated mouth cavity complex has a plurality of upper lip shape cavities and a plurality of lower lip shape cavities, wherein the animated mouth cavity complex has a lip shape cavity that simulates a contoured upper lip, a lip shape cavity that simulates a curved lower lip, and lip shape cavities that simulate pursed upper and lower lips, and wherein the multiple predetermined mouth configurations established by selective illumination of the illumination devices in optical communication with the cavities forming the animated mouth cavity complex comprise a first mouth configuration simulative of the human utterance of the letters A and I, a second mouth configuration simulative of the human utterance of the letter E, a third mouth configuration simulative of the human utterance of the letters O and U, and a fourth mouth configuration simulative of a human smile.

2. The illuminated display device of claim 1 further comprising a panel applied over at least a portion of the base member and over the plurality of cavities wherein the panel is translucent over at least a portion of each of the plurality of cavities.

3. The illuminated display device of claim 2 further comprising a lens disposed over each of at least some of the plurality of cavities.

4. The illuminated display device of claim 1 wherein each cavity has an illumination volume and further comprising reflective material interposed between the illumination volume of each cavity and the base member.

5. The illuminated display device of claim 4 wherein each cavity has an open inner volume bounded by a layer of reflective material applied to the wall surface of the cavity.

6. The illuminated display device of claim 4 further comprising optical waveguide material disposed in each cavity and wherein a layer of reflective material is interposed between the optical waveguide material and the wall surface of the cavity.

7. The illuminated display device of claim 1 further comprising a speaker for emitting sounds and a means for synchronizing sounds emitted by the speaker with the pattern of illumination of the illumination devices.

8. The illuminated display device of claim 1 wherein the animated talking character further has a left eye cavity with an illumination device in optical communication therewith and a right eye cavity with an illumination device in optical communication therewith whereby the animated talking character further comprises left and right eyes that can be selectively illuminated.

9. The illuminated display device of claim 8 wherein the animated talking character has independently operable primary eye illumination and secondary eye illumination for each of the left and right eyes.

10. The illuminated display device of claim 8 further comprising a panel applied over at least a portion of the base member and over the plurality of cavities wherein the panel has an outside surface and an inside surface and wherein the panel is translucent over at least a portion of each of the plurality of cavities and further comprising a first image applied to the outside surface of the panel in registration with each eye cavity and a second image applied to the inside surface of the panel in registration with each eye cavity.

11. An illuminated display device comprising:

a base member with a surface;

a plurality of cavities in the base member wherein each cavity has a wall surface and a cavity opening contiguous with the surface of the base member;

a plurality of illumination devices wherein at least one illumination device is disposed in optical communication with each cavity for providing illumination within the cavity and for emitting light through the opening;

means for illuminating the at least one illumination device disposed in optical communication with each cavity to illuminate the cavity and to emit light through the opening to provide an illuminated display; and an optical fiber with a first portion in optical communication with the illumination device and a second portion in optical communication with a cavity for providing illumination in the cavity.

12. The illuminated display device of claim 11 further comprising means for causing the plurality of illumination devices to illuminate in a pattern.

13. The illuminated display device of claim 12 wherein the means for causing the plurality of illumination devices to illuminate in a pattern comprises a processor.

14. The illuminated display device of claim 12 wherein the illuminated display device comprises an animated talking character with a plurality of cavities that form an animated mouth cavity complex with multiple predetermined mouth lighting configurations established by selective illumination of the illumination devices in optical communication with the cavities forming the animated mouth cavity complex.

15. The illuminated display device of claim 14 wherein the animated mouth cavity complex has a plurality of upper lip shape cavities and a plurality of lower lip shape cavities.

16. The illuminated display device of claim 15 wherein the animated mouth cavity complex has a lip shape cavity that simulates a contoured upper lip, a lip shape cavity that simulates a curved lower lip, and lip shape cavities that simulate pursed upper and lower lips.

17. The illuminated display device of claim 11 further comprising a positively shaped light emitting member of translucent material disposed in each cavity and in optical communication with at least one illumination device.

18. The illuminated display device of claim 17 further comprising a layer of reflective material disposed on a portion of each light emitting member to enhance internal reflection within the light emitting member and to enhance light emission from the light emitting member.

19. The illuminated display device of claim 11 further comprising optical waveguide material disposed in the cavities wherein the optical waveguide material is in optical communication with an illumination device.

20. The illuminated display device of claim 19 wherein the illumination devices comprise light emitting diodes (LEDs) and wherein at least a portion of an LED protrudes into each cavity.

21. An illuminated display device comprising:

a base member with a surface;

a plurality of cavities in the base member wherein each cavity has a wall surface and a cavity opening contiguous with the surface of the base member;

a plurality of illumination devices wherein at least one illumination device is disposed in optical communication with each cavity for providing illumination within the cavity and for emitting light through the opening;

means for illuminating the at least one illumination device disposed in optical communication with each cavity to illuminate the cavity and to emit light through the opening to provide an illuminated display; and optical waveguide material disposed in the cavities wherein the optical waveguide material is in optical communication with an illumination device and wherein the optical waveguide material is inserted into the cavities in fluid form for subsequent curing while at least a portion of an LED protrudes into each cavity wherein at least a portion of each LED is encapsulated within and in direct contact with the optical waveguide material.

22. The illuminated display device of claim 21 wherein the optical waveguide material comprises a transparent, flexible polymer.

23. An animated talking character illuminated display device comprising:

a base member with a surface;

a plurality of light emitting members coupled to the base member;

a plurality of illumination devices wherein at least one illumination device is disposed in optical communication with each light emitting member for providing illumination within the light emitting member and for emitting light from the light emitting member;

means for illuminating the at least one illumination device in optical communication with each light emitting member to illuminate the light emitting members and to emit light from the light emitting members to provide an illuminated display;

means for causing the plurality of illumination devices to illuminate in a pattern;

wherein a plurality of light emitting members are disposed in an animated mouth complex with multiple predetermined mouth lighting configurations established by selective illumination of the illumination devices in optical communication with the light emitting members forming the animated mouth complex;

wherein the animated mouth complex has a lip shape light emitting member that simulates a contoured upper lip, a lip shape light emitting member that simulates a curved lower lip, and lip shape light emitting members that simulate pursed upper and lower lips and wherein the multiple predetermined mouth configurations established by selective illumination of the illumination devices in optical communication with the light emitting members forming the animated mouth complex comprise a first mouth configuration simulative of the human utterance of the letters A and I, a second mouth configuration simulative of the human utterance of the letter E, a third mouth configuration simulative of the human utterance of the letters O and U, and a fourth mouth configuration simulative of a human smile.

24. The animated talking character illuminated display device of claim 23 wherein the animated mouth complex has a plurality of upper lip shape light emitting members and a plurality of lower lip shape light emitting members.

25. The animated talking character illuminated display device of claim 24 wherein the animated talking character further has a left eye light emitting member with an illumination device in optical communication therewith and a right eye light emitting member with an illumination device in optical communication therewith whereby the animated talking character further comprises left and right eyes that can be selectively illuminated.

26. The animated talking character illuminated display device of claim 23 further comprising a speaker for emitting sounds and a means for synchronizing sounds emitted by the speaker with the pattern of illumination of the illumination devices.

27. The animated talking character illuminated display device of claim 23 wherein each light emitting member has an illumination volume and further comprising reflective material interposed between the illumination volume and the base member.

28. The animated talking character illuminated display device of claim 27 wherein each light emitting member comprises a cavity in the base member with an open inner volume bounded by a layer of reflective material applied to a wall surface of the cavity.

29. The illuminated display device of claim 23 wherein each light emitting member comprises a cavity in the base member in combination with optical waveguide material disposed in each cavity.

* * * * *